US005709148A

United States Patent [19]

Uera et al.

[11] Patent Number: 5,709,148

[45] Date of Patent: Jan. 20, 1998

[54] INK-FURNISHING APPARATUS

[75] Inventors: Yoshinori Uera; Taiichi Ichizawa; Kohji Yoshizawa, all of Kawasaki; Takashi Iijima, Yokosuka, all of Japan

[73] Assignee: Kabushiki Kaisha Tokyo Kikai Seisakusho, Tokyo, Japan

[21] Appl. No.: 572,533

[22] Filed: Dec. 14, 1995

[30] Foreign Application Priority Data

Jun. 24, 1995 [JP] Japan ..... 7-180673
Jul. 22, 1995 [JP] Japan ..... 7-207801

[51] Int. Cl.[6] ..... B41F 31/04; B41F 31/06

[52] U.S. Cl. ..... 101/350; 101/365

[58] Field of Search ..... 101/348–352, 101/353, 363, 364, 365, 366, 147, 148, 208–210; 118/259, 261, 262

[56] References Cited

FOREIGN PATENT DOCUMENTS 1-93397 4/1989 Japan ..... B41N 7/00
7-45244 5/1995 Japan ..... B41F 31/14

*Primary Examiner*—J. Reed Fisher
*Attorney, Agent, or Firm*—Trexler, Bushnell, Giangiorgi & Blackstone, Ltd.

[57] ABSTRACT

An ink furnishing apparatus is capable of furnishing relative high viscosity ink in keyless ink furnishing. The apparatus operates in such a manner that an ink drawn from an ink fountain by rotation of a fountain roller and having a thickness corresponding to a first gap is supplied to the peripheral surface with compression by passing through a second gap, is provided fluidity by compression and disrupter through contact between the peripheral surfaces of an uneven surface roller and an intermediate roller and contact between the peripheral surfaces of the intermediate roller and a metering roller for supplying to the peripheral surface of the metering roller, the excess amount of ink on the peripheral surface of the metering roller is scraped off by a doctor means and returned to the ink fountain for supplying substantially uniform amount of ink at any axial position of the metering roller to a printing plate on a plate cylinder via the peripheral surface of the form roller.

51 Claims, 27 Drawing Sheets

INK-FURNISHING APPARATUS

BACKGROUND OF THE INVENTION

1. Field of the Invention

The present invention relates generally to an ink furnishing apparatus for a printing press. More specifically, the invention relates to a multi-function type ink furnishing apparatus which is based on a keyless type ink furnishing apparatus requiring no adjustment of ink furnishing amount for furnishing an ink adjusted into substantially uniform thickness on the overall surface of a printing plate by means of a metering roller and is designed for adapting to relatively high viscosity ink utilizing the facility of the keyless ink furnishing apparatus.

2. Description of the Related Art

As disclosed in Japanese Unexamined Patent Publication (Kokai) No. Heisei 1-93397, for example, the conventional keyless ink furnishing apparatus furnishes an ink over the entire surface of the press plate in substantially uniformly by carrying the ink in an ink pan by rotating an ink fountain roller or duct roller partially dipped in the ink within the ink pan, transferring the ink to a downstream side metering roller, scraping out an excess amount of the ink by means of a doctor plate contacting on the peripheral surface of the metering roller to limit a furnishing ink amount in an amount determined by a capacity of a large number of metering cells (recesses) provided on the overall surface of the metering roller for furnishing substantially uniform amount of the ink.

However, while the conventional keyless ink furnishing apparatus is adapted to low viscous ink, when high viscous ink is used, adhering ability of the ink on the peripheral surface of the fountain roller is low in comparison with the low viscous ink. Thus, amount of the ink carried upwardly with the peripheral surface of the fountain roller becomes insufficient to make it impossible to effectively furnish the ink.

Commonly owned Japanese Examined Patent Publication (Kokoku) No. Heisei 7-45244 proposes a high viscous ink adapted type keyless ink furnishing apparatus adapted to relatively high viscous ink, in which an ink contained in an ink fountain formed by a tilted plate and the periphery of the fountain roller, is carried out from a gap defined between the peripheral surface of the fountain roller and the lower end of the tilted plate by rotating the fountain roller.

However, the high viscous adapted type keyless ink furnishing apparatus sill hold problems, such as splashing of ink or so forth to be solved.

At first, splashing of ink is caused for opposite directions of rotation between the fountain roller and a downstream side roller to cause movement of the peripheral surfaces of the rollers in mutually opposite directions. When the ink is transferred between the peripheral surfaces of the rollers moving in opposite directions, splashing of the ink is caused. Particularly, higher rotation speed of the rollers results in greater ink splashing amount to lower ink furnishing efficiency and to stain the environment.

Next, the high viscous ink drawn out of the ink fountain reaches the peripheral surface of a metering roller without being increased the fluidity by application of a large external force. Due to poor fluidity of the ink and since large pushing force does not act upon transferring of the ink from the fountain roller to the metering roller, the high viscous ink cannot be satisfactorily received within recesses on the peripheral surface of the metering roller. Thus, desired amount of the ink cannot be supplied to the metering roller.

On the other hand, the most important advantage common to all of the keyless ink furnishing apparatus set forth above, i.e. the function for constantly furnishing of ink in substantially uniform thickness over the entire surface of the printing plate without adjustment by ink adjustment key, may serve as disadvantage for color printing by using of high viscous ink. Namely, in the current printing businesses, in the color printing utilizing relatively high viscous ink, it is frequently required to locally furnishing ink for quite limited portion on the printing surface as a spot color printing and is not required to furnish the ink over the entire printing surface. In such case, when the conventional keyless ink furnishing apparatus is used, the ink is inherently furnished even for the portion where furnishing of ink is not required. Therefore, large amount of ink should be wasted. Furthermore, furnishing the ink in the extra areas inherently require cleaning of unnecessarily large area to waste labor and time to degrade efficiency of printing operation.

In addition, there are demand for printing of special color other than three primary colors (yellow, cyan and magenta) or black with an ink having higher viscosity than the normal in, for high quality printing superior in complexion and volume utilizing three primary color inks and/or black ink of higher viscosity than that of the normal ink. For performing printing with satisfying such demands, a printing facility for high quality printing becomes necessary for difficulty of application of a printing facility employing the conventional keyless ink furnishing. Therefore, in order to perform both paintings, it is required to have two kinds of mutually different printing facilities to be wasteful in viewpoint of installation space, investment for the apparatus.

SUMMARY OF THE INVENTION

It is an object of the present invention to provide an ink furnishing apparatus which can solve the drawbacks in the prior art as set forth above.

A second object of the present invention is to provide an ink furnishing apparatus, in which a facility is provided in an ink furnishing path from an ink fountain to recesses of a peripheral surface of a metering roller for temporally providing fluidity for a high viscous ink which is difficult to deposit on the recesses of the peripheral surface of the metering roller due to high viscosity and cannot be smoothly supplied to a printing plate on a plate cylinder in the prior art, and thus smooth ink furnishing utilizing a keyless ink furnishing apparatus is enabled even for relatively high viscosity ink.

A third object of the present invention is to provide a dedicated keyless type ink furnishing apparatus suitable for uniformly printing over entire surface on normal quality using relatively high viscous ink.

A fourth object of the present invention is to provide a multi-function ink furnishing apparatus which is operable in keyless furnishing mode suitable for uniform printing of entire surface of normal quality utilizing the relatively high viscous ink, and in non-keyless ink furnishing mode suitable for partial printing of high image quality.

According to the first aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain; and an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

whereby the ink furnishing apparatus operating in such a manner that the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the intermediate roller and contact between the peripheral surfaces of the intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller.

According to second aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller, the doctor means including means for selectively switching the position of the doctor means between a position contacting with the peripheral surface of the metering roller and a position released away from the peripheral surface of the metering roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain; and first gap adjusting means provided separately provided in the ink fountain for respective of divided zones defined along axial direction of the fountain roller for adjusting the first gap, an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the intermediate roller and contact between the peripheral surfaces of the intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor means being released away from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the intermediate roller and contact between the peripheral surfaces of the intermediate roller and the metering roller for supplying to the peripheral surface of the metering roller and thus supplying the ink supplied on the metering roller to a printing plate on a plate cylinder via the peripheral surface of the form roller.

According to a third aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of the metering roller in the direction of ink furnishing;

doctor roller for contacting with the peripheral surface of the metering roller at a position downstream of the contact position between the intermediate roller and the metering roller and upstream of the contact position between the metering roller and the form roller, the doctor roller including means for selectively switching the rotation of the doctor roller between a rotation for scraping off the ink from the peripheral surface of the metering roller and a rotation for not scraping off the ink;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain; and first gap adjusting means provided separately provided in the ink fountain for respective of divided zones defined along axial direction of the fountain roller for adjusting the first gap, an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of s uneven surface roller and the intermediate roller and contact between the peripheral surfaces of the intermediate roller and the metering roller for supplying to the peripheral surface of the metering roller, the excess amount of ink on the peripheral surface of the metering roller is scraped off by the doctor roller and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor roller being rotated in the mode not scraping off the ink from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the intermediate roller and contact between the peripheral surfaces of the intermediate roller and the metering roller for supplying to the peripheral surface of the metering roller and thus supplying the ink supplied on the metering roller to a printing plate on a plate cylinder via the peripheral surface of the form roller.

According to a fourth aspect of the invention, an ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers;

whereby the ink furnishing apparatus being in operation such a manner that the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, and contact between the peripheral surfaces of the second intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller.

According to a fifth aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers and reciprocating in an axial direction for a given stroke;

whereby the ink furnishing apparatus being in operation such a manner that the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, extension in axial direction on the peripheral surface caused by rotation and reciprocal motion of the ink cylinder and contact between the peripheral surfaces of the second intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller.

According to a sixth aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, and contact between the peripheral surfaces of the second intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor means being released away from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, and contact between the peripheral surfaces of the second intermediate roller and the metering roller for supplying to the peripheral surface of the metering roller for supplying to the peripheral surface of the metering roller and thus supplying the ink supplied on the metering roller to a printing plate on a plate cylinder via the peripheral surface of the form roller.

According to a seventh aspect of the invention, an ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor means for contacting with the peripheral surface of the metering roller at a position downstream of the contact position between the intermediate roller and the metering roller and upstream of the contact position between the metering roller and the form roller;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers and reciprocating in an axial direction for a given stroke;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, extension in axial direction on the peripheral surface caused by rotation and reciprocal motion of the ink cylinder and contact between the peripheral surfaces of the second intermediate roller and the metering roller for supplying to the peripheral surface of the metering roller, the excess amount of ink on the peripheral surface of the metering roller is scraped off by the doctor means and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor means being released away from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, extension in axial direction on the peripheral surface caused by rotation and reciprocal motion of the ink cylinder and contact between the peripheral surfaces of the second intermediate roller and the metering roller for supplying to the peripheral surface of the metering roller for supplying to the peripheral surface of the metering roller and thus supplying the ink supplied on the metering roller to a printing plate on a plate cylinder via the peripheral surface of the form roller.

According to the eighth aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor roller for contacting with the peripheral surface of the metering roller at a position downstream of the contact position between the intermediate roller and the metering roller and upstream of the contact position between the metering roller and the form roller, the doctor roller including means for selectively switching the rotation of the doctor roller between a rotation for scraping off the ink from the peripheral surface of the metering roller and a rotation for not scraping off the ink;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, and contact between the peripheral surfaces of the second intermediate roller and the metering roller for supplying to the peripheral surface of the metering roller, the excess amount of ink on the peripheral surface of the metering roller is scraped off by the doctor roller and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor roller being rotated in the mode not scraping off the ink from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, and contact between the peripheral surfaces of the second intermediate roller and the metering roller for supplying to the peripheral surface of the metering roller for supplying to the peripheral surface of the metering roller and thus supplying the ink supplied on the metering roller to a printing plate on a plate cylinder via the peripheral surface of the form roller.

According to the ninth aspect of the invention, an ink furnishing apparatus for a printing press for performing printing by furnishing an ink to a printing plate on a plate cylinder, comprises:

a form roller rotating in contact with a peripheral surface of the printing plate;

a metering roller rotating with contacting a peripheral surface thereof with the upstream side of the peripheral surface of the formed roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of the metering roller in the direction of ink furnishing;

doctor roller for contacting with the peripheral surface of the metering roller at a position downstream of the contact position between the intermediate roller and the metering roller and upstream of the contact position between the metering roller and the form roller, the doctor roller including means for selectively switching the rotation of the doctor roller between a rotation for scraping off the ink from the peripheral surface of the metering roller and a rotation for not scraping off the ink;

an ink fountain opposing to the upper portion of the doctor means and opened at the front side and the upper side, and constituted of both side plates and tilted base;

a fountain roller having a peripheral surface located at a position for blocking the opened front side of the ink fountain, a position adjacent the front edge of the ink fountain via a first gap, and shifting downwardly at the position mating with the front side of the ink fountain;

an uneven surface roller positioned adjacent the peripheral surface of the fountain roller at the downstream side position via a second gap narrower than the first gap, rotating with contacting with the peripheral surface of the intermediate roller at the upstream side position, and having a uniformly distributed unevenness;

a first intermediate roller rotating with contacting with the downstream side of the peripheral surface of the uneven surface roller; and an ink cylinder rotating with contacting with the peripheral surfaces of both of the first and second intermediate rollers and reciprocating in an axial direction for a given stroke;

the apparatus being selectively operable in:

an entire surface ink furnishing mode, in which the first gap is held fully opened, the doctor means is placed in contact with the metering roller, the ink drawn from the ink fountain by rotation of the fountain roller and having a thickness corresponding to the first gap is supplied to the peripheral surface with compression by passing through the second gap, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, extension in axial direction on the peripheral surface caused by rotation and reciprocal motion of the ink cylinder and contact between the peripheral surfaces of the second intermediate roller and the metering roller for supplying to the peripheral surface of the metering roller, the excess amount of ink on the peripheral surface of the metering roller is scraped off by the doctor roller and returned to the ink fountain for supplying substantially uniform amount of ink at any axial position of the metering roller to a printing plate on a plate cylinder via the peripheral surface of the form roller, and a local ink furnishing mode, in which the first gap is adjusted to be narrower to the necessary size with respect to separated zones by adjusting means, the doctor roller being rotated in the mode not scraping off the ink from the peripheral surface of the metering roller, the ink drawn from the ink fountain by rotation of the fountain roller per each separated zones in the desired thickness is supplied on the peripheral surface of the uneven surface roller at an amount corresponding to the thickness of the ink passed through the second gap per each separated zone, is provided fluidity by compression and disrupter through contact between the peripheral surfaces of the uneven surface roller and the first intermediate roller, contact between the peripheral surfaces of both of the first and second intermediate cylinders and the peripheral surface of the ink cylinder, extension in axial direction on the peripheral surface caused by rotation and reciprocal motion of the ink cylinder and contact between the peripheral surfaces of the second intermediate roller and the metering roller for supplying to the peripheral surface of the metering roller for supplying to the peripheral surface of the metering roller and thus supplying the ink supplied on the metering roller to a printing plate on a plate cylinder via the peripheral surface of the form roller.

In respective aspect set forth above, the fine recesses of the metering roller may be cavities regularly arranged on the peripheral surface. It is further desirable that the fine recesses of the metering roller are recesses opening the peripheral surface, in which hollow portions uniformly distributed an outer periphery are opened to the peripheral surface.

On the other hand, the doctor means may be one of a doctor blade, doctor bar and doctor roller rotating at opposite direction to cause shifting of the peripheral surface in a direction opposite to the shifting direction of the peripheral surface of the metering roller, at the contact positions. The unevenness of the uneven surface roller may comprise a plurality of projections regularly surrounded by the grooves in the circumference thereof.

In the operation of the ink furnishing apparatus according to the present invention constructed as set forth above, at first, when the high viscous ink is filled in the ink fountain, despite of the fact that the first gap is formed between the front edge of the bottom portion of the ink fountain and the peripheral surface of the fountain roller, the ink is stored in the ink fountain without flowing out through the first gap by its own deformation, low flow ability.

Then, by rotating the fountain roller to cause downward movement of the peripheral surface blocking the opened front side of the ink fountain, the ink adhering on the peripheral surface of the fountain roller by its own viscosity is drawn to cause displacement. As a result, the ink is drawn out of the ink fountain with being extended in a thickness to pass through the first gap.

Thus, by continuous rotation of the fountain roller, the high viscous ink in the ink fountain is drawn in the uniform thickness from the ink fountain with adhering on the peripheral surface of the fountain roller to reach the second gap defined between the peripheral surface of the fountain roller and the peripheral surface of the metering roller. The second gal is smaller than the first gap. Accordingly, the ink adhering on the peripheral surface of the fountain ink is further compressed to be thinner through the second gap and depressed onto the metering roller. At this time, the external acting on the ink causes temporary softening of the ink to temporarily increase flow ability of the ink.

The uneven surface roller is driven to rotate for causing shifting or displacement of the peripheral surface in the same direction to the peripheral surface of the fountain roller, and the peripheral speed thereof is set to be higher than the peripheral speed of the fountain roller. Accordingly, transfer of the ink from the peripheral surface of the fountain roller to the peripheral surface of the uneven surface roller is effectively performed by embedding the projecting portions of the peripheral surface of the uneven surface roller into the ink on the peripheral surface of the fountain roller to scrape the ink off the latter. The ink thus scraped is received within the recessed portions on the peripheral surface of the uneven surface roller.

The ink supplied to the peripheral surface of the uneven surface roller reaches the contact position with the intermediate roller by rotation of the uneven surface roller and transferred to the peripheral surface of the intermediate roller at the contact position. The ink on the intermediate roller then reaches the contact position with the metering roller by rotation of the intermediate roller to be transferred to the metering roller.

During transfer of the ink from the uneven surface roller to the intermediate roller and from the intermediate roller to the metering roller through contact positions, depression force is externally loaded by the mating peripheral surfaces of the rollers to cause compression and disrupter of the ink membrane. Thus, as set forth above, the ink is temporarily softened to have greater fluidity. Thus, ink transfer can be certainly and efficiently performed.

The ink thus transferred to the peripheral surface of the metering roller is transferred to the contact position of the doctor means by rotation of the metering roller. Then, the extra amount of ink is scraped off by the doctor means from the peripheral surface of the metering roller. The scraped ink is collected in the upwardly opened ink fountain located below the doctor means.

As the doctor means, a scraper type doctor means having a fixed contacting portion to contact with the peripheral surface of the metering roller, such as the doctor blade, the doctor bar, and a rotary type doctor means having rotating contact portion to contact with the peripheral surface of the metering roller, such as the doctor roller. The doctor roller rotates at lower peripheral speed than that of the metering roller, or, in the alternative to rotate in the opposite direction to shift the peripheral surface at the contacting position in the direction opposite to the motion direction of the peripheral surface of the metering roller for scraping off the ink.

When the later rotary type doctor means is employed, utilizing elastic hydro lubrication phenomenon, the ink amount to be retained on the periphery of the metering roller can be adjusted. By this, the printing density of the overall printing surface becomes possible.

The ink on the peripheral surface of the metering roller after scraping off the extra amount of the ink by the doctor means reaches the contacting position with the form roller according to rotation of the metering roller to be transferred to the peripheral surface of the form roller. The ink carried on the peripheral surface of the form roller reaches the contacting position with the printing plate by rotation of the form roller. Thus, ink is furnished onto the overall surface of the printing plate in substantially equal thickness.

The peripheral surface at the downstream of the form roller after contacting with the printing plate differentiates the thickness of the remaining ink at the portion where ink is supplied to the image portion and the portion where ink is not supplied, at a timing immediately after transfer of the ink. However, by subsequent rotation, in the similar operation to those set forth above, the ink in the amount compensating the thickness difference is supplied. Thus ink furnishing to the printing plate and supply of the ink from the metering roller is sequentially repeated.

It should be noted that the metering roller and the form roller in ink furnishing are driven at substantially equal peripheral speed to the peripheral speed of the printing plate on the plate cylinder. Also, the peripheral surfaces of the contacting two rollers shifts in the same direction at the contacting portion. By this, ink furnishing or supply to the downstream can be smoothly performed to successfully prevent unnecessary wearing of the rollers or generation of the resistance heat.

Next, in the case of printing requiring ink furnishing for entire area of the printing plate uniformly, or printing which can be done by ink furnishing for entire area of the printing plate uniformly, the print can be performed with the keyless ink furnishing mode. On the other hand, in case of printing, in which keyless ink furnishing should cause waste of ink in significant amount or difficulty or not be suitable, the ink furnishing mode is switched into the non-keyless ink furnishing mode.

Namely, in case of the second, fourth to seventh aspects of the invention, by contacting of the doctor means onto the peripheral surface of the metering roller and in case of the third, eighth and ninth aspects of the invention, by switching the rotation mode of the doctor roller from the rotation not scraping the ink to the rotation scraping off the ink, the extra amount of ink on the peripheral surface of the metering roller. In either case, by operating in the condition where the first gap adjusting means provided in the ink fountain is placed in fully open position, the ink can always be furnished uniformly over the entire surface of the printing plate, similarly to the first aspect of the invention set forth above.

On the other hand, by shifting the doctor means away from the peripheral surface of the metering roller in the case of the first and second aspect of the invention, and by switching operation mode of the doctor roller from the rotation for scraping off the ink to the rotation not scraping the ink, and in conjunction therewith by adjusting the first gap per respective of divided zones along the axial direction of the fountain roller by the first gap adjusting means provided in the ink fountain, adapting to the distribution of the image on the printing plate surface, necessary amount of ink can be furnished for desired portion of the printing plate.

In order to shut off ink furnishing from the fountain roller to the metering roller with respect to the zone which is not required to furnish the ink, the peripheral surface of the roller contacting thereof generates a heat on the peripheral surface by repeated contact with elastic deformation by contact. By this heat, the dampening water in a form of thin film can be promoted to evaporate. Thus, the dampening water can be successfully removed from the ink furnishing apparatus.ned by the front edge of the base of the ink fountain and the peripheral surface of the fountain roller is adjusted to be smaller than the second gap between the fountain roller and the metering roller by the first gap adjusting means.

On the other hand, for furnishing the ink only for the limited separated zone, the ink fountain is divided into a plurality of zones corresponding to the separated zones and the ink is filled only in the divided zones corresponding to the separated zone requiring furnishing of the ink.

In the second, eighth and ninth aspects of the invention, when the doctor roller is driven to cause rotation in the mode not to scrape off the ink from the peripheral surface of the metering roller, the doctor roller may serve as a rider roller providing depression force for the ink on the peripheral surface of the metering roller to cause disrupter of the ink.

In the fourth to ninth aspects of the invention, the ink transferred on the uneven surface roller reaches the first intermediate roller by rotation of the uneven surface roller to be transferred onto the peripheral surface of the first intermediate roller through the contact poisition therebetween. Then, the ink carried on the peripheral surface of the first intermediate roller reaches the contact position with the peripheral surface of the ink cylinder to be transferred on the peripheral surface of the ink cylinder. Then, the ink on the peripheral surface of the ink cylinder is transferred to the second intermediate roller through the contact position therebetween.

During transfer of the ink from the uneven surface roller to the first intermediate roller, from the first intermediate roller to the ink cylinder, from the ink cylinder to the second intermediate roller and from the second intermediate roller to the metering roller through contact positions, depression force is externally loaded by the mating peripheral surfaces of the rollers to cause compression and disrupter of the ink membrane. Thus, as set forth above, the ink is temporarily softened to have greater fluidity. Thus, ink transfer can be certainly and efficiently performed.

Also, in the fifth, seventh and ninth aspects, the ink cylinder is driven in axial direction for reciprocal motion in the predetermined stroke. Therefore, at the contact positions between the first intermediate roller and the ink cylinder and between the second intermediate roller and the ink cylinder, the ink is forced to be extended in the axial direction by oscillation of the ink cylinder in the axial direction.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
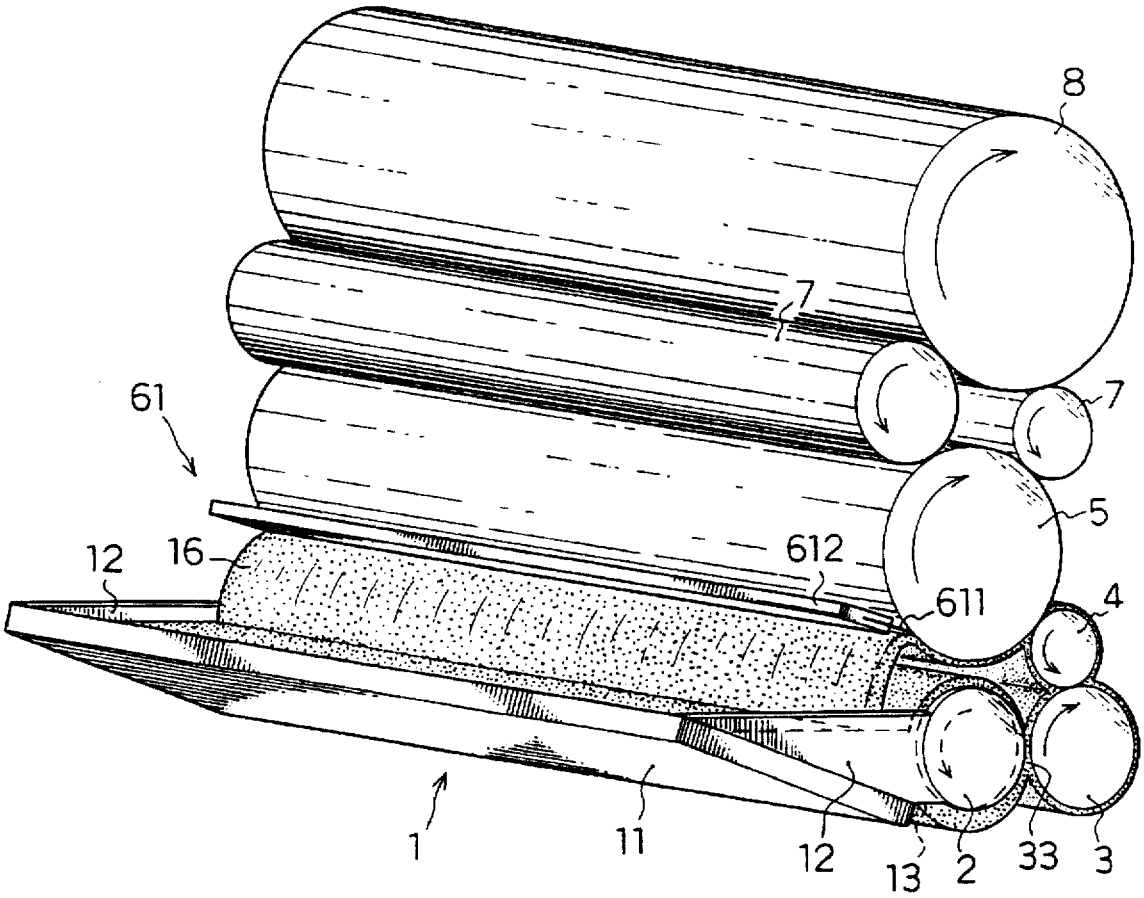
FIG. 1 is a perspective view of the first embodiment of an ink furnishing apparatus according to the present invention.
Figure 8:
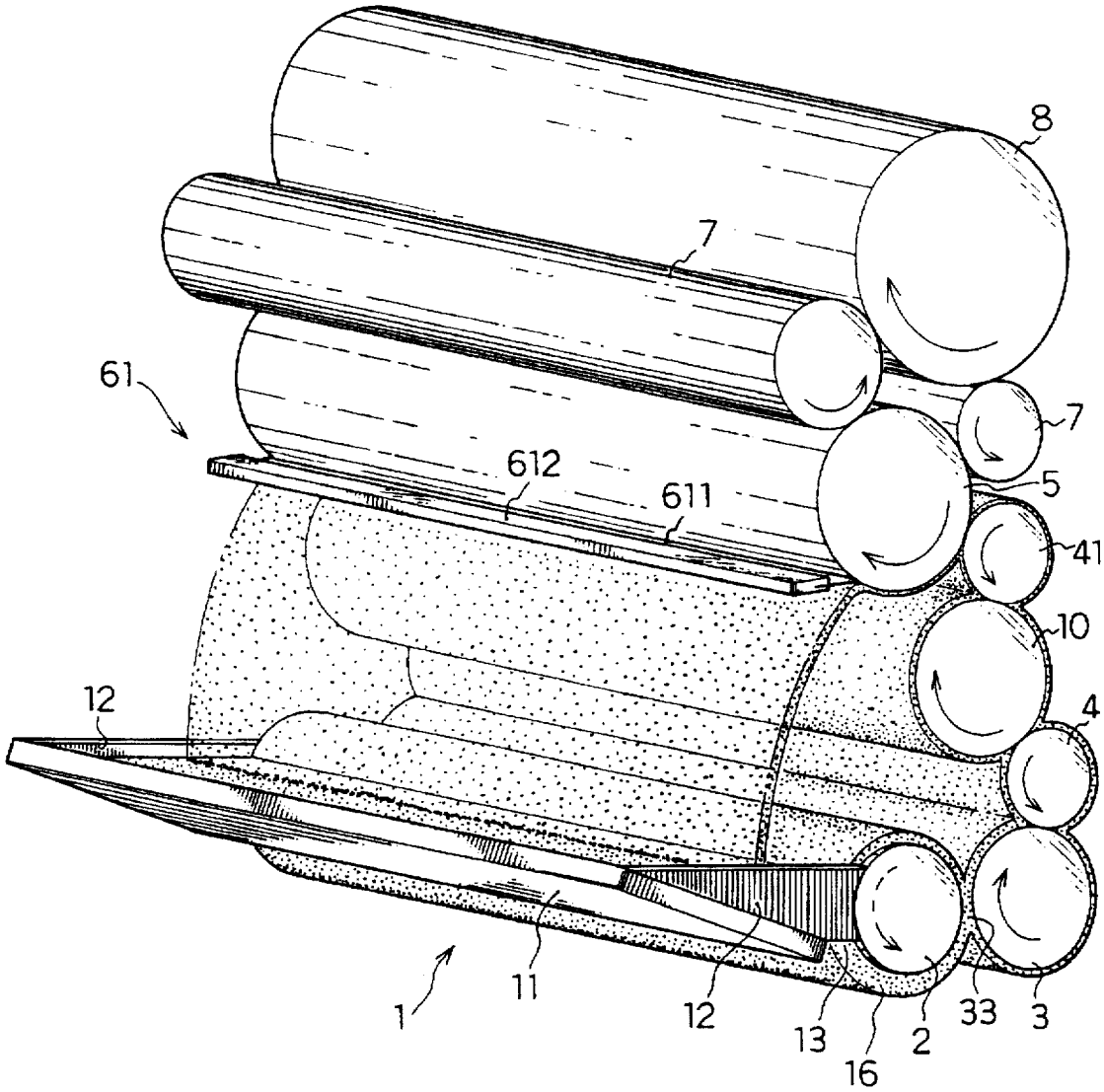
FIG. 8 is a general perspective view of second embodiment of the ink furnishing apparatus according to the present invention.

FIGS. 1 and 8 are perspective views showing general constructions of the preferred embodiments of ink furnishing apparatus according to the present invention. In FIGS. 1 and 8, an ink fountain 1 is constructed with a base 11 descending toward the peripheral surface of a fountain roller 2 and side plates 12 partitioning both sides of a groove defined by the base 11 and the fountain roller 2. The ink fountain 1 is opened in the upper portion and stores an ink within the groove. Between the descending lower end of the base 11 and the peripheral surface of the fountain roller 2, a first gap 13 (see FIG. 31) is provided. The ink in the first gap 13 is drawn by rotation of the fountain roller 2 by deposition on the peripheral surface thereof.

Figure 5:
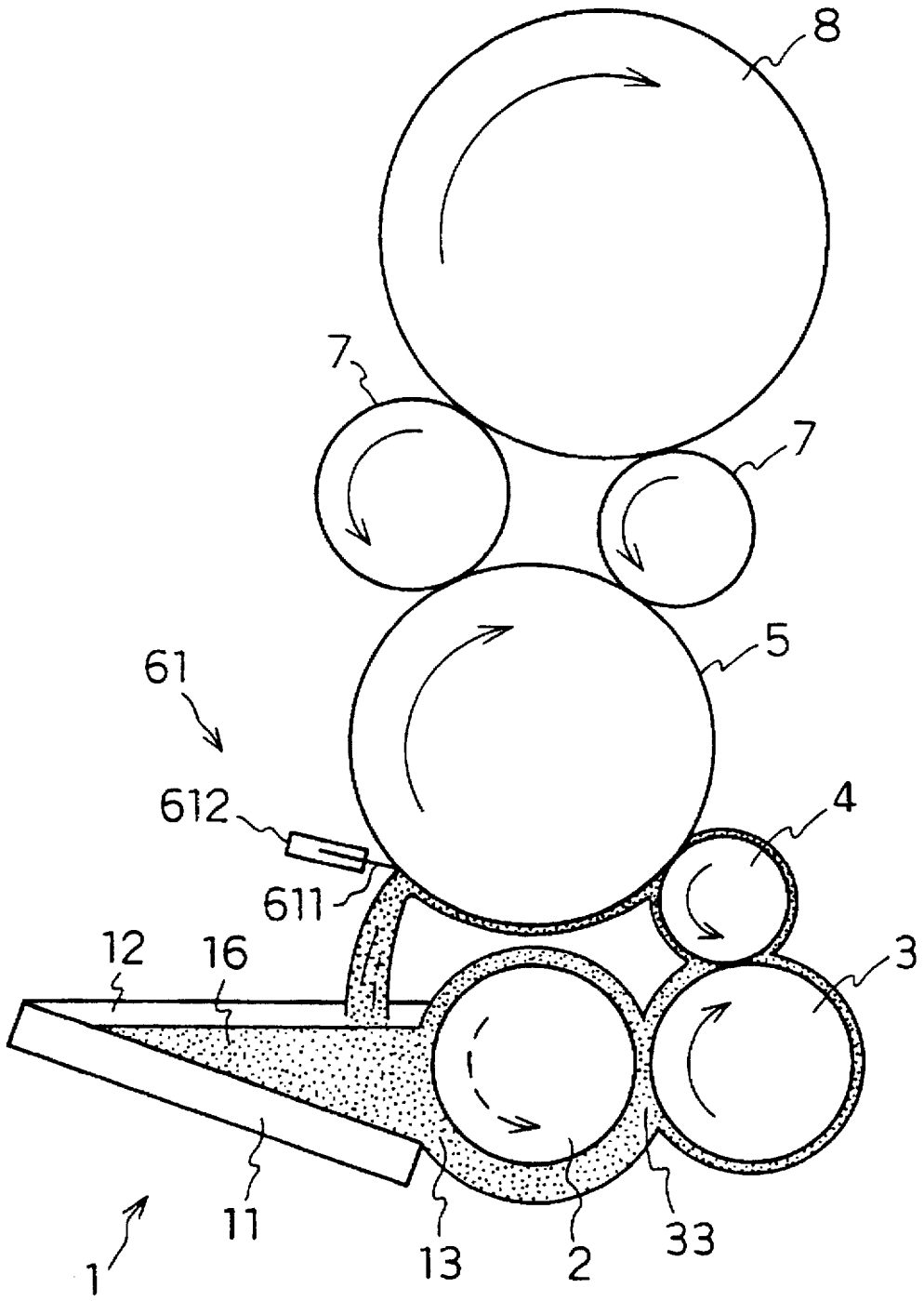
FIG. 5 is a sectional side elevation showing an embodiment of a dedicated keyless type ink furnishing apparatus according to the present invention employing a doctor blade as a doctor means, as application of the first embodiment of the ink furnishing apparatus.
Figure 6:
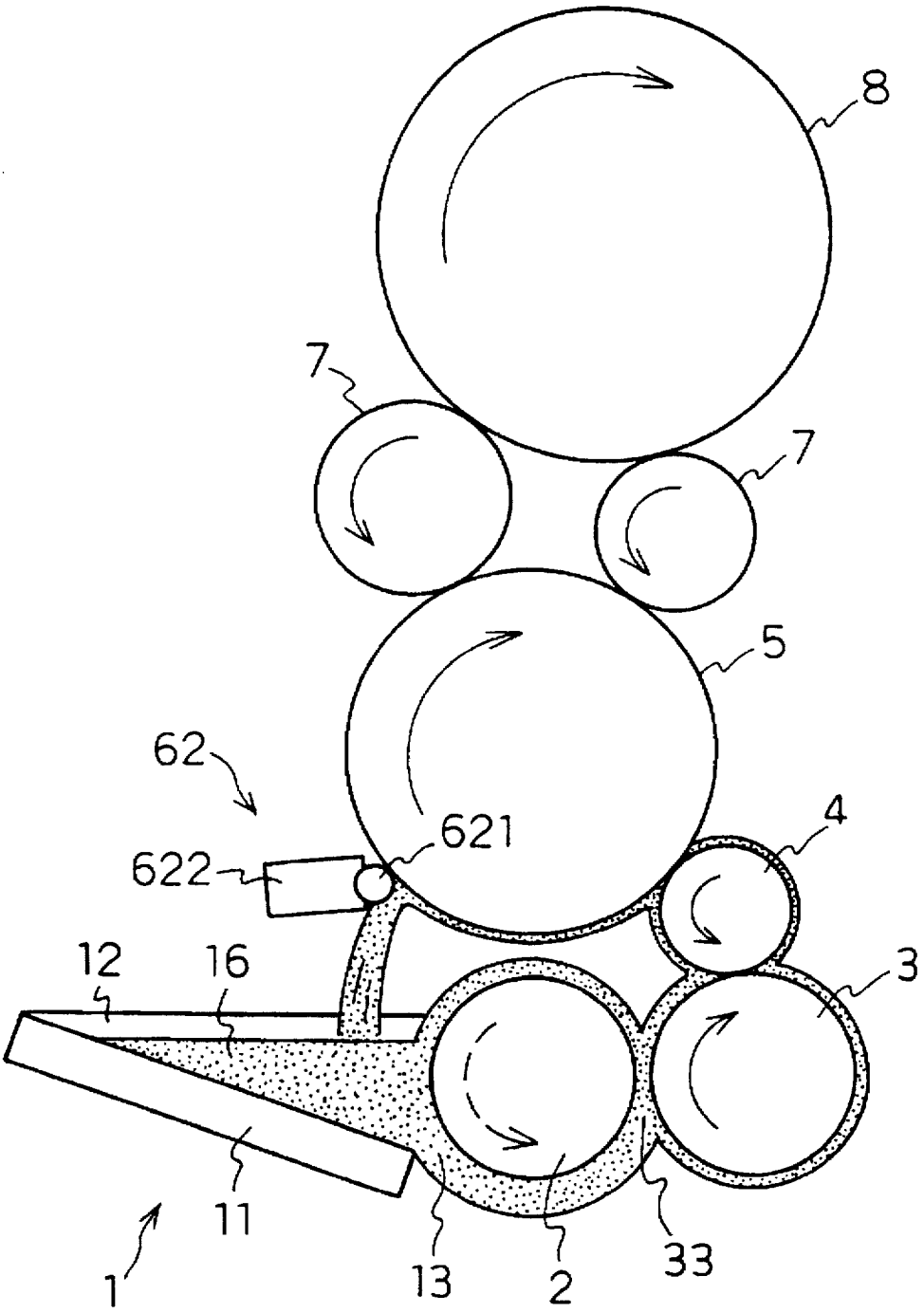
FIG. 6 is a sectional side elevation showing another embodiment of a dedicated keyless type ink furnishing apparatus according to the present invention employing a doctor bar as a doctor means, as application of the first embodiment of the ink furnishing apparatus.
Figure 7:
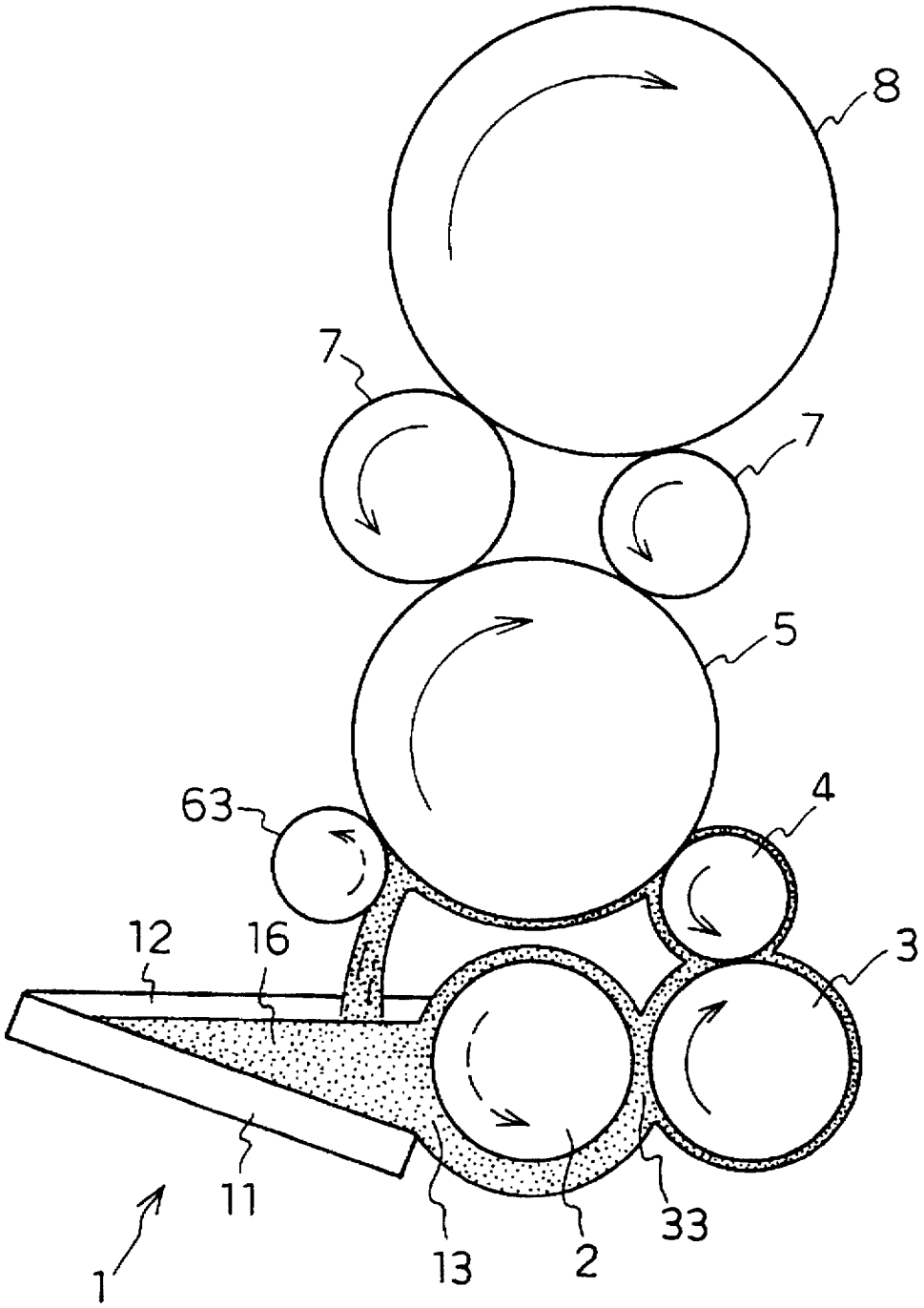
FIG. 7 is a sectional side elevation showing a further embodiment of a dedicated keyless type ink furnishing apparatus according to the present invention employing a doctor roller as a doctor means, as application of the first embodiment of the ink furnishing apparatus.

The first gap 13 is fixed in the embodiment shown in FIGS. 5 to 7. In the alternative, the first gap 13 is divided into a plurality of given width of divided zones in the axial direction of the fountain roller and is adjustable of the open area by means of an adjusting means 14 for the first gap per each divided zone.

Figure 31:
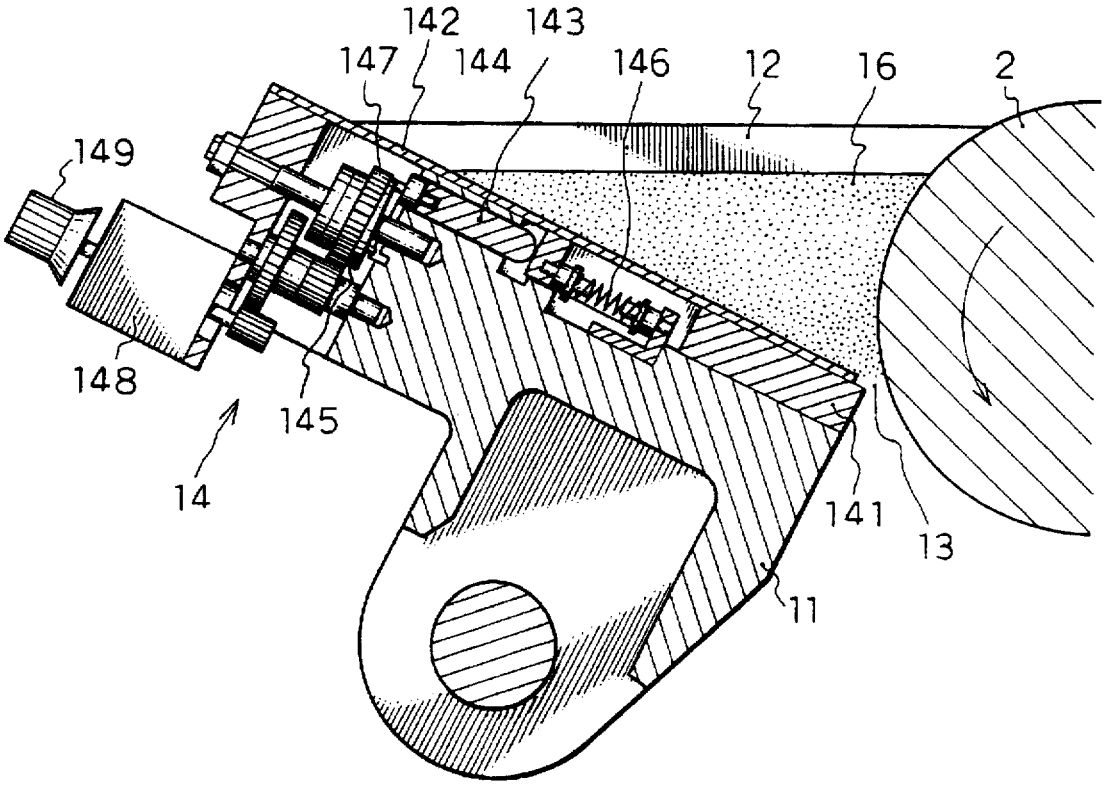
FIG. 31 is a longitudinal section showing one embodiment of an adjusting means of a first gap provided in the ink fountain in the ink furnishing apparatus.

As shown in FIG. 31, for example, the first gap adjusting means 14 is constructed by securing a bottom plate 142 with a predetermined clearance to the tilted upper surface of the base 11, disposing a plurality of divided adjusting plates 141 having a thicknesses corresponding to the clearance in a condition where a plurality of divided adjusting plates 141 are mutually contacting to each other along the axial direction of the fountain roller 2, and providing shifting mechanism for each divided adjusting plate for shifting the latter toward and away from the peripheral surface of the fountain roller 2.

The shifting mechanism includes a compression spring 146 for biasing the divided adjusting plate 141 in a direction away from the peripheral surface of the fountain roller 2, a push rod 143 abutting to the rear end of the divided adjusting plate 141 and exerting a force against the spring force of the compression spring 146, an end cam 145 opposing to the read end of the push rod 143 and having a ring-shaped cam face, a cam follower 144 mounted on the read end of the push rod 143 and contacting with the cam face of the end cam 145, a driving source 148 for driving to rotate the end cam 145 and a transmission mechanism 147 constituted of a plurality of mutually meshed gears for transmitting the driving force of the driving source 148. It should be noted that the driving source 148 is provided with an operation knob 149 at one end of an output shaft thereof for permitting manual input of the driving force.

The opened front edge portion of the ink fountain 1 is blocked by the peripheral surface of the fountain roller 2 which is provided with defining the first gap 13 with the lower end of the tilted surface of the base 11.

The fountain roller 2 is driven to rotate in a direction that the peripheral surface of thereof blocking the opened front edge portion of the ink fountain moves downwardly. The peripheral speed in rotation of the fountain roller 2 is variable depending upon the peripheral speed of a printing plate but roller than the latter in the extent of 1/30 to 1/100, for example.

At downstream of the fountain roller 2 in the ink furnishing, an uneven surface roller 3 is provided. The peripheral surface of the uneven surface roller 3 is opposed to the peripheral surface of the fountain roller 2 with defining a second gap 33 (see FIGS. 5 to 7, 13 to 19 and 9 to 11) which is smaller than the first gap 13, therebetween.

Figure 4:
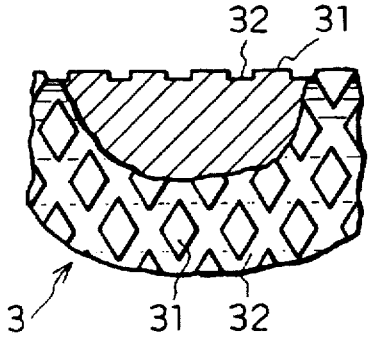
FIG. 4 is a partially sectioned engaged view showing one embodiment of an uneven surface roller in the first embodiment of the ink furnishing apparatus of the invention.

As shown in FIG. 4, on the peripheral surface of the uneven surface roller 3, a plurality of projections 31 separated by grooves 32 extending therearound so as to facilitate reception of ink on the peripheral surface of the fountain roller 2. The configuration of the projection 4 may be triangular, circular or so forth, other than rhombi shaped configuration as illustrated in FIG. 4. The projections 31 are arranged in a pitch of 0.5 to 5 mm. On the other hand, in place of regular unevenness as shown in FIG. 1, satin form unevenness may be uniformly provided on the peripheral surface.

In the first embodiment, as shown in FIG. 1, at the down stream of the uneven surface roller 3 in terms of ink supply, an intermediate roller 4, a metering roller 5, a form roller 7 are arranged with respectively contacting the peripheral surfaces in order. The peripheral surface of the form roller 7 is in contact with a printing plate on a plate cylinder 8. The uneven surface roller 3, the intermediate roller 4, the metering roller 5 and the form roller 7 are rotated at substantially equal peripheral speed to the peripheral speed of the plate cylinder.

The mutually contacting fountain roller 2, the uneven surface roller 3, the intermediate roller 4, the metering roller 5 and the form roller 7 are adapted to be rotated for shifting the peripheral surfaces in the same direction at the mutually mating portions or contacting portions. The form roller 7 id displaced in the direction same as the direction of displacement of the peripheral surface of the printing plate, at the contact portion with the printing plate.

In the layout of the rollers as set forth above, during the ink transfer process wherein the ink is transferred from the uneven surface roller 3 to the intermediate roller 4 and is supplied to the metering roller 5 at the downstream side, the ink is compressed and split twice. By repeated compression and spiting, the ink is temporarily softened and thus is temporarily provided fluidity. Therefore, good ink transfer condition can be established. It should be noted that the intermediate roller 4 is a roller having a rubber surface layer with surface hardness of 20 to 40 of Shore A.

In the embodiment illustrated in FIG. 8, the first intermediate roller 4 and a second intermediate roller 41 are provided. The first intermediate roller 4 is a rubber roller having a rubber surface layer with surface hardness of 20 to 40 of Shore A. The peripheral surface of the first intermediate roller 4 is located in contact with both of the peripheral surface of the uneven surface roller 3 and the peripheral surface of the ink cylinder 10. Rotating direction of the first intermediate roller 4 is to cause displacement of the peripheral surface in the same direction to the displacement directions of respective peripheral surfaces of the uneven surface roller 3 and the ink cylinder 10.

The ink cylinder 10 is a metal cylinder provided downstream of the uneven surface roller 3 in terms of ink supply via the first intermediate roller 4 and located in contact with the peripheral surface of the first intermediate roller 4 and the peripheral surface of the second intermediate roller 41. The peripheral surface of the ink cylinder 10 is coated by copper for better wetting ability by the ink and for better ink reception ability.

The ink cylinder 10 is driven to rotate at substantially equal peripheral speed to the peripheral speed of the printing plate of the plate cylinder 8 for displacement in the same direction to the latter. Furthermore, rotating direction of the ink cylinder 10 is to cause displacement of the peripheral surface thereof in the same direction to the peripheral surface of the first intermediate roller 4 located upstream side and to the peripheral surface of the second intermediate roller 41 located downstream.

In the rotating condition, the ink cylinder 10 is reciprocate in the axial direction thereof with a predetermined stroke. At the axial end, the ink cylinder 10 is cooperated with an oscillation mechanism (not shown) such as that disclosed in Japanese Examined Patent Publication (Kokoku) No. Showa 57-15552, for example. The disclosure of the above-identified Japanese Examined Patent Publication No. Showa 57-15552 is herein incorporated by reference for the sake of disclosure. The ink cylinder 10 as cooperatively associated with the oscillation mechanism reciprocate in the axial direction by own rotation. In practice, the reciprocating operation of the ink cylinder 10 is set in a stroke of 10 to 500 mm per 20 cycles of rotation of the ink cylinder, for example.

The second intermediate roller 41 is a rubber roller having a rubber surface layer with surface hardness of 20 to 40 of Shore A. The peripheral surface of the intermediate roller 41 is located in contact with the peripheral surface of the ink cylinder 10 and the metering roller 5. Particularly, the contact position of the intermediate roller 41 relative to the peripheral surface of the metering roller 5 is the peripheral surface portion of the metering roller upstream of a contact position of a doctor means 6 and downstream of the contact position of the form roller 7. It should be noted that the rotating direction of the second intermediate roller 41 is in a direction to cause displacement of the peripheral surface thereof in the same direction of displacement of the peripheral surfaces of the ink cylinder 10 and the metering roller 5.

At downstream side of the second intermediate roller in terms of ink supply, the metering roller 5 and the form roller 7 are provided in order with contacting the peripheral surfaces. The peripheral surface of the form roller 7 is located in contact with the printing plate of the plate cylinder 8. Then, the second intermediate roller 41, the metering roller 5 and the form roller 7 rotate at the peripheral speed substantially equal to the peripheral speed of the plate cylinder.

On the other hand, the fountain roller 2, the uneven surface roller 3, the first intermediate roller 4, the ink cylinder 10, the second intermediate roller 41, the metering roller 5, the form roller 7 rotates in respective directions to cause displacement of the peripheral surfaces of the mating rollers in the same directions to each other, at respective of mutually mating portions or mutually contacting portions. The form roller 7 rotates in the direction to cause displacement of the peripheral surface in the same direction to the peripheral surface of the plate cylinder at the contact portion with the latter.

With the layout of the components set forth above, the ink is supplied from the uneven surface roller to the first intermediate roller 4 and then transferred to the ink cylinder 10. During this ink transfer process, the ink is compressed and split twice. Then, the ink is temporarily softened and temporarily provided fluidity for better condition to be supplied to the downstream components.

The ink thus fluidized temporarily is further compressed and split by rotational contact between the ink cylinder 10 and the second intermediate roller 41 located downstream thereof to further increase fluidity. On the other hand, since the ink cylinder 10 oscillates in the axial direction, at the contact portion between the peripheral surface of the upstream side first intermediate roller 4 and the peripheral surface of the downstream side second intermediate roller 41, the ink is subject a force for spreading in the axial direction of the ink cylinder 10. Thus, the ink is distributed and extended in the axial direction of the ink cylinder 10 to be a thin layer. During this process, fluidity of the ink is further increased.

It should be noted that the ink furnishing apparatus including the ink cylinder 10 and the first and second intermediate rollers 4 and 41 contacting on the peripheral surface of the former is applied for a printing press which uses a dampening water, and if the dampening water penetrates into the construction set forth above, formation of thin film of dampening water is significantly promoted owing to development of the ink in the axial direction by compression and split by contact between the cylinder and the roller, and oscillation of the ink cylinder 10. In conjunction therewith, due to head generated by repeated elastic deformation of the first and second intermediate rollers 4 and 41 having rubber layers on the peripheral surfaces, the dampening water is heated to evaporate. Thus, the penetrated water can be effectively removed.

In the step in advance of supplying of the high viscosity ink drawn from the ink fountain 1 onto the metering roller, the ink is physically provided sufficient fluidity. The ink thus fluidized is then supplied to the peripheral surface of the metering roller 5 via the peripheral surface of the second intermediate roller 41.

Figure 2:
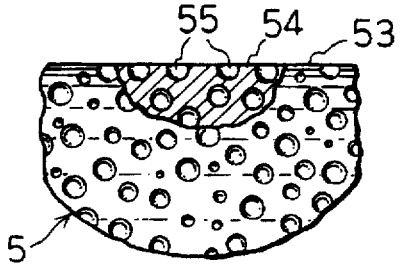
FIG. 2 is a partially sectioned enlarged view showing one embodiment of the peripheral surface of a metering roller in the first embodiment of the ink furnishing apparatus according to the invention.
Figure 3:
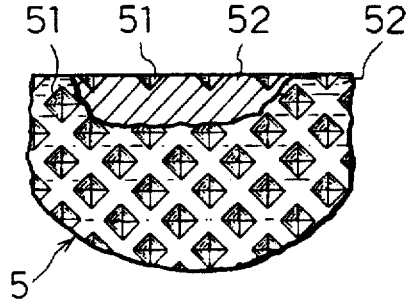
FIG. 3 is a partially sectioned enlarged view showing another embodiment of the peripheral surface of the metering roller in the first embodiment of the ink furnishing apparatus according to the invention.

As shown in FIG. 2, a large number of fine ink receptacle cavities or recesses which may receive a predetermined amount of ink are uniformly distributed on the peripheral surface of the metering roller 5. The fine ink receptacle cavities are defined by fine voids uniformly distributed in a matrix 34 forming an outer peripheral layer 33 of the metering roller 5. Namely, in more concrete, the outer peripheral layer 33 of the metering roller 5 is formed by a material, in which fine hollow body called micro balloons of 5 to 300 μm in diameter are mixed with a synthetic resin matrix for uniform dispersion.

The metering roller 5 formed with uniformly dispersing the fine voids in the matrix 54 forming the outer peripheral layer 53 will not cause significant or noticeable variation of the ink amount to be stored in the cavities on the peripheral surface of the metering roller 5 even when the peripheral surface of the metering roller 5 is worn by repeated ink scraping action of a doctor means 6 which will be discussed later, since the lost volume of the ink receptacle amount by wearing off of some fine voids 55 can be compensated by the voids newly exposed to the peripheral surface.

The metering roller 5 having the outer peripheral layer formed by dispersing the fine void 55 in the synthetic resin matrix is formed to have a Shore hardness in a range of 70 to 100 (Shore A).

In the alternative, the metering roller 5 with a uniformly distributed fine cavities may also formed by a large number of regularly arranged recessed cells 51 and ridges 52 surrounding respective cells. Such recessed cell 51 may be formed by rolling, laser dulling or corrosion on the surface of a material, such as metal, synthetic resin, tangusten carbide and so forth, in a density of 80 lines/cm to 200 lines/cm.

The doctor means 6 is located to contact with the peripheral surface of the metering roller at the position downstream of the contact position with the intermediate roller 4, in the rotating direction of the metering roller 5, and upstream of the contact position with the form roller. In the concrete construction, the doctor means 6 comprises a doctor blade 61 shown in FIGS. 5 and 9, a doctor bar 62 shown in FIGS. 6 and 10, and a doctor roller 63 shown in FIGS. 7 and 11. All of these contact with the peripheral surface of the metering roller 5 over the entire length. By contact of these onto the metering roller 5, excess amount of ink on the peripheral surface of the metering roller 5 is scraped off.

Figure 9:
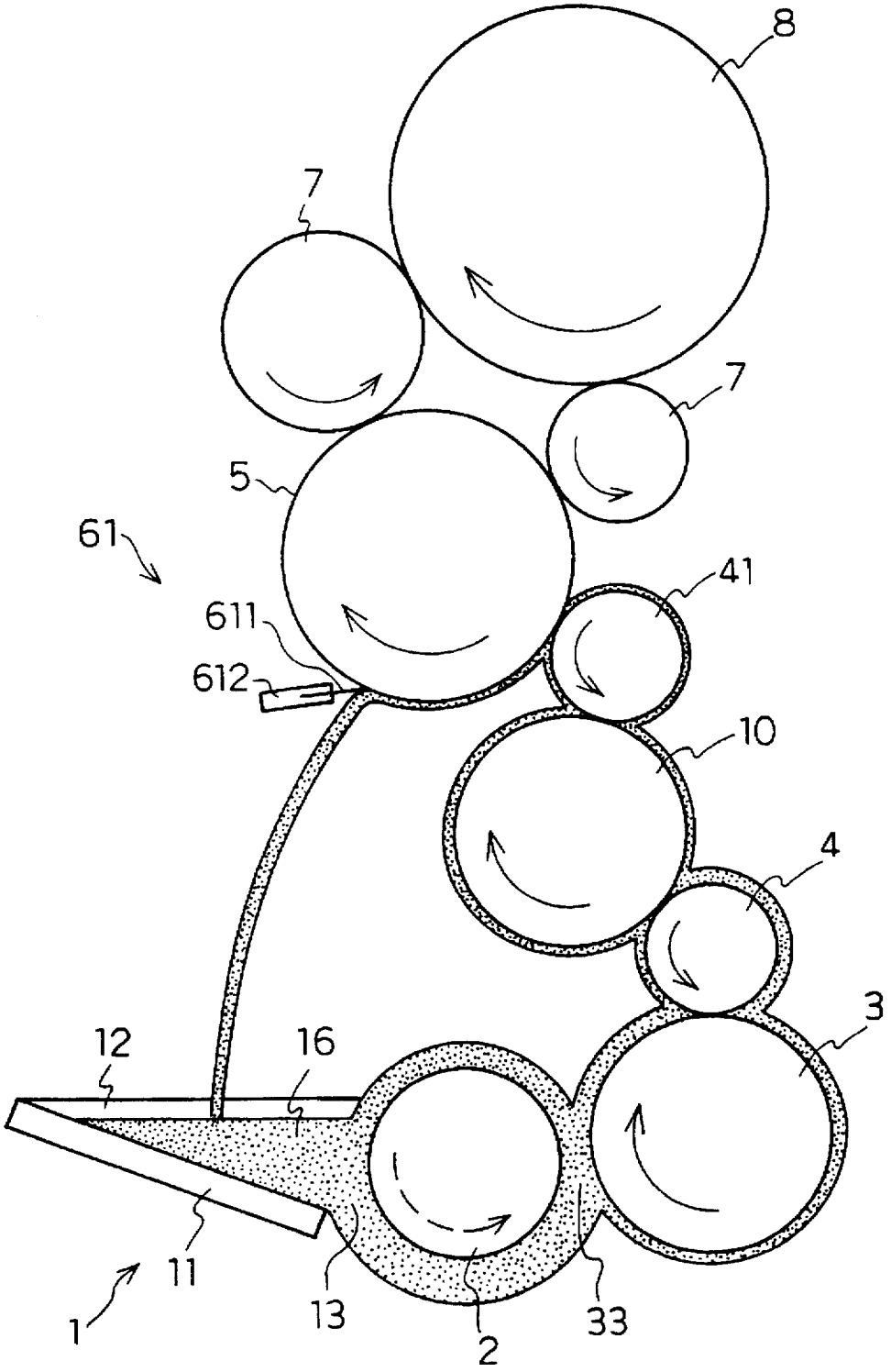
FIG. 9 is a sectional side elevation showing an embodiment of a dedicated keyless type ink furnishing apparatus according to the present invention employing a doctor blade as a doctor means, as application of the second embodiment of the ink furnishing apparatus.

In FIGS. 5 and 9, the doctor blade 61 includes a blade 611 contacting with the peripheral surface of the metering roller 5 and a blade holder 612 supporting the blade 611. The doctor blade 61 is supported on a not shown frame.

Figure 10:
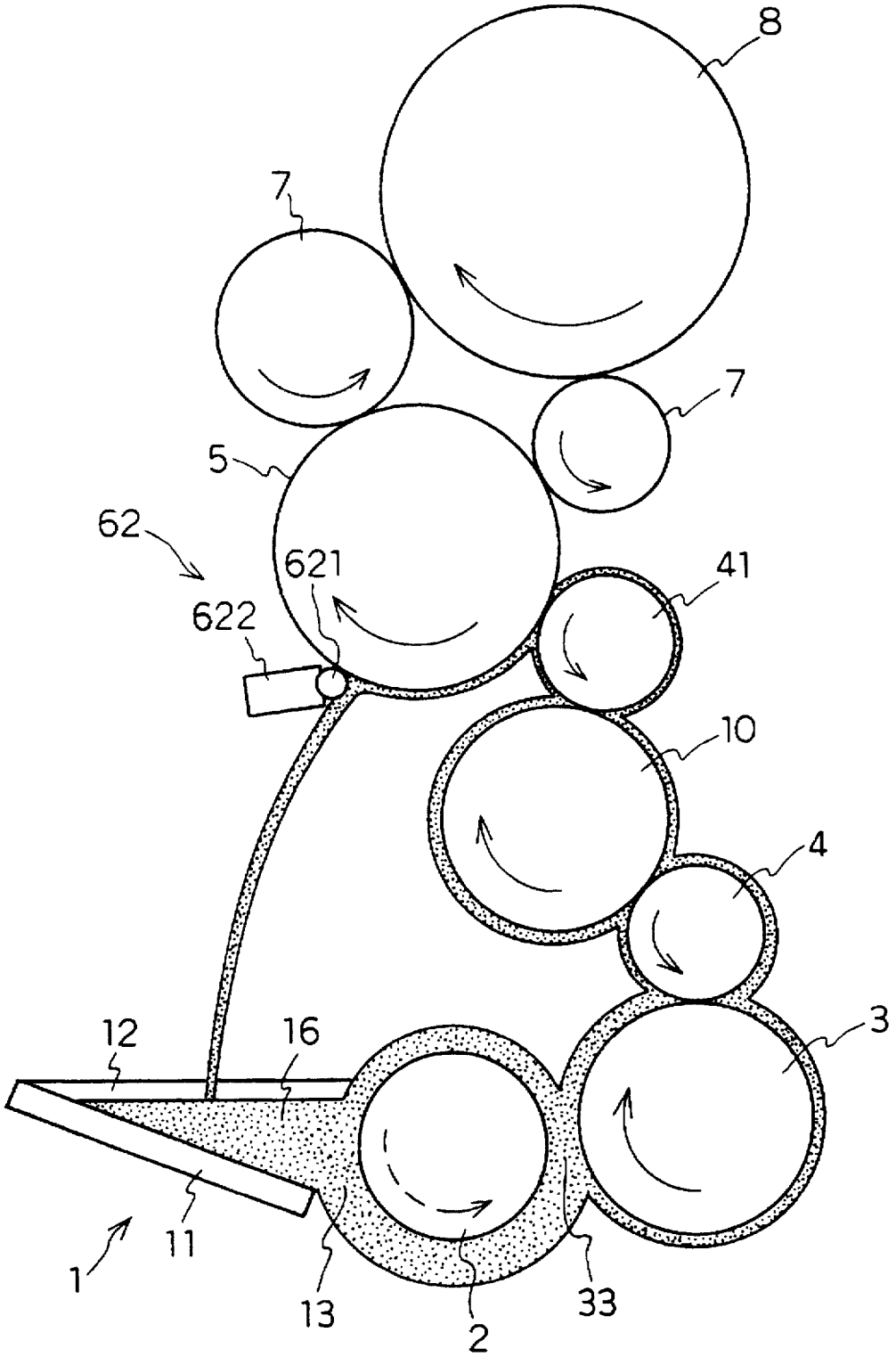
FIG. 10 is a sectional side elevation showing an embodiment of a dedicated keyless type ink furnishing apparatus according to the present invention employing a doctor bar as a doctor means, as application of the second embodiment of the ink furnishing apparatus.

In FIGS. 6 and 10, the doctor bar 62 comprises a bar 621 contacting with the peripheral surface of the metering roller 5 and a back-up stay 622 restricting deflecting deformation of the bar. The doctor bar 62 is supported on a not shown frame.

Figure 11:
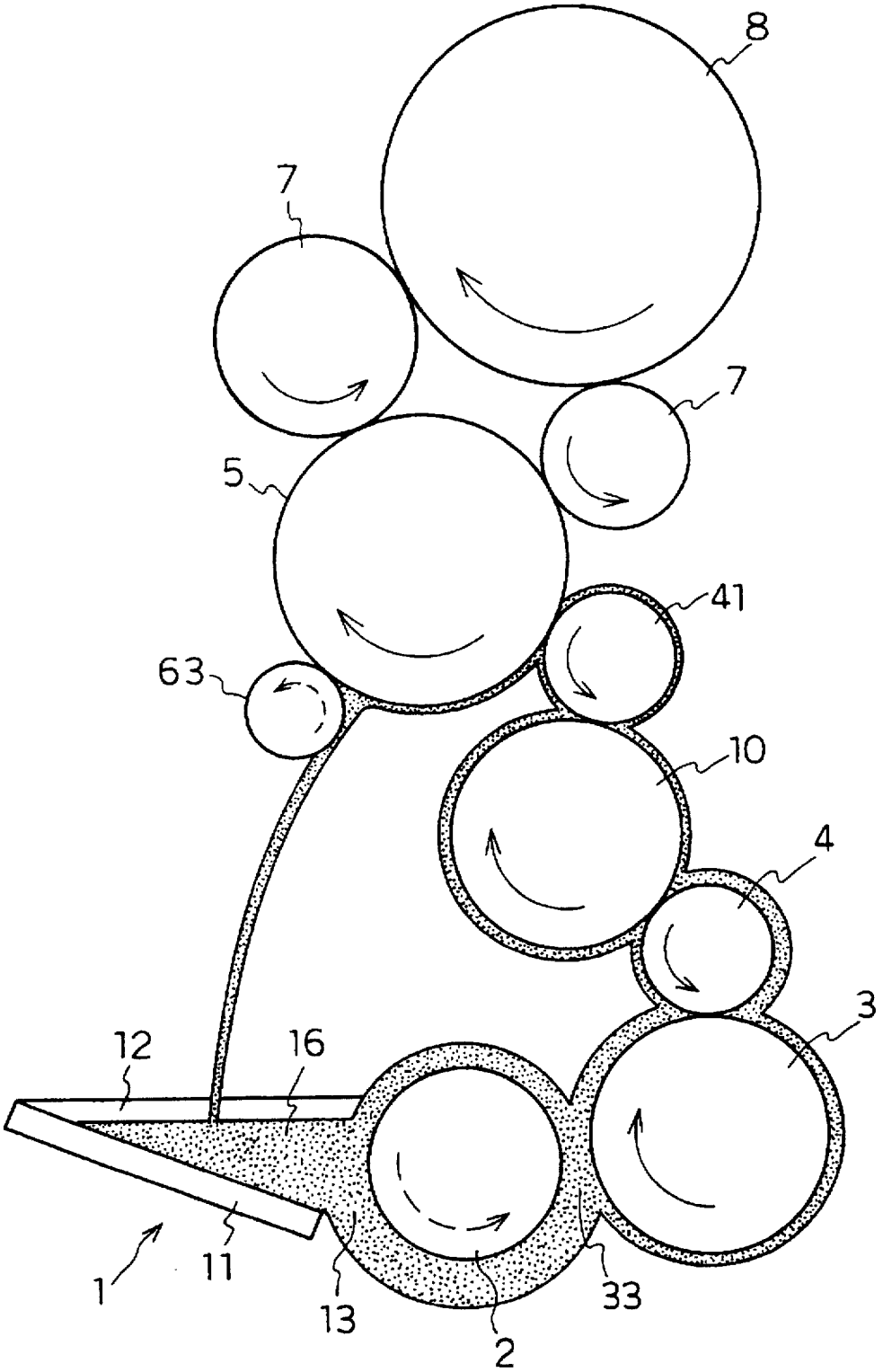
FIG. 11 is a sectional side elevation showing an embodiment of a dedicated keyless type ink furnishing apparatus according to the present invention employing a doctor roller as a doctor means, as application of the second embodiment of the ink furnishing apparatus.

In FIGS. 7 and 11, the doctor roller 63 contacts with the peripheral surface of the metering roller 5. The doctor roller 63 is supported on a not shown frame.

Figure 12:
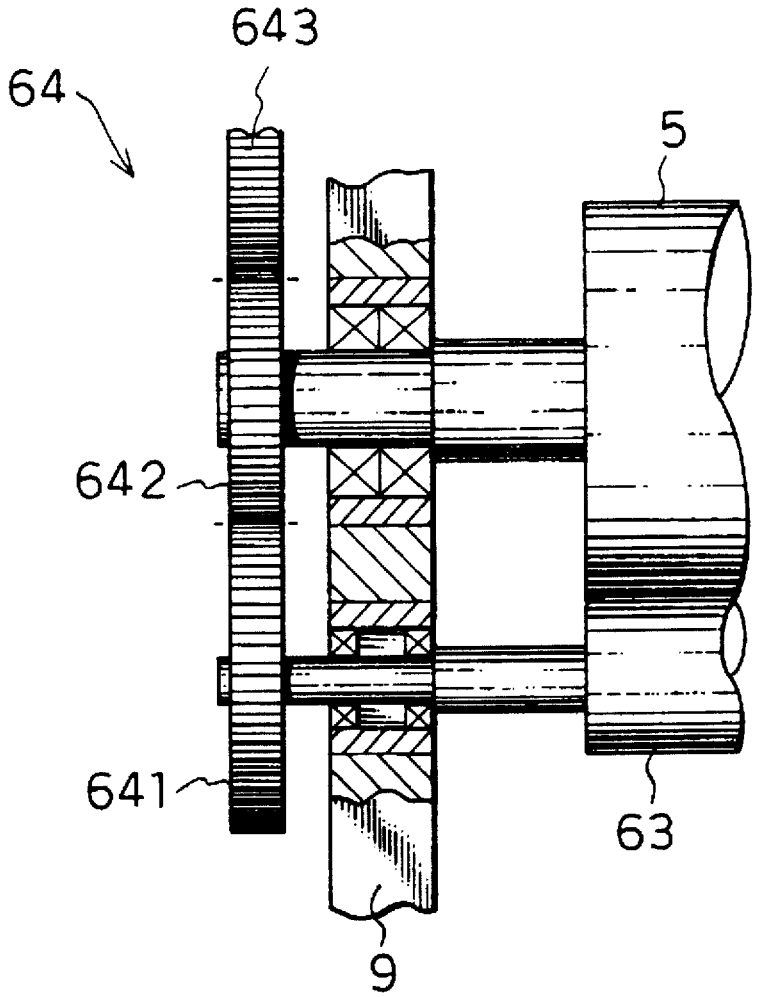
FIG. 12 is a partially sectioned enlarged view showing one example of a drive mechanism of the doctor roller shown in FIGS. 7 and 11.
Figure 13:
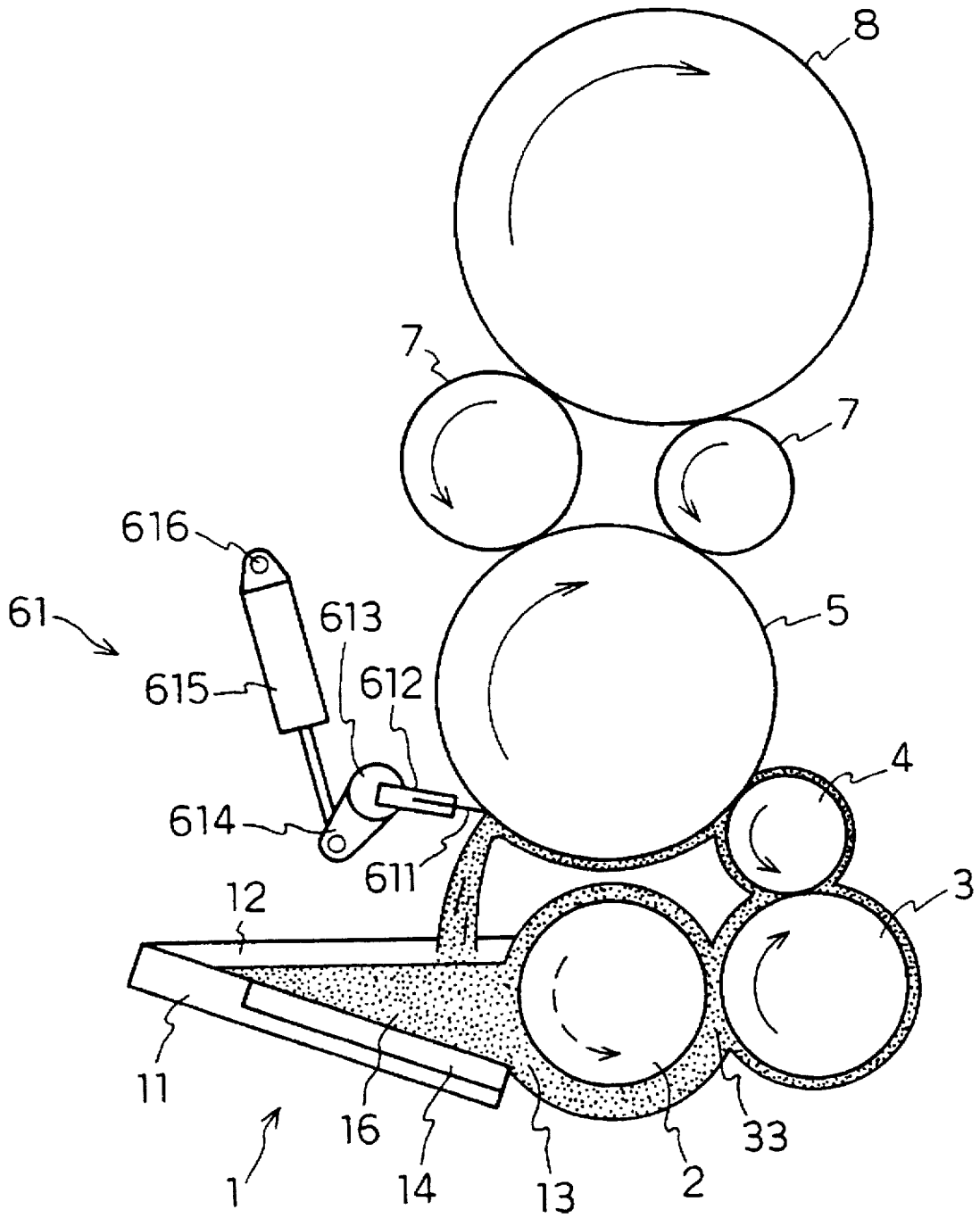
FIG. 13 is a sectional side elevation of an embodiment of keyless and non-keyless type ink furnishing apparatus employing the doctor blade as the doctor means, which is in keyless ink furnishing mode.
Figure 14:
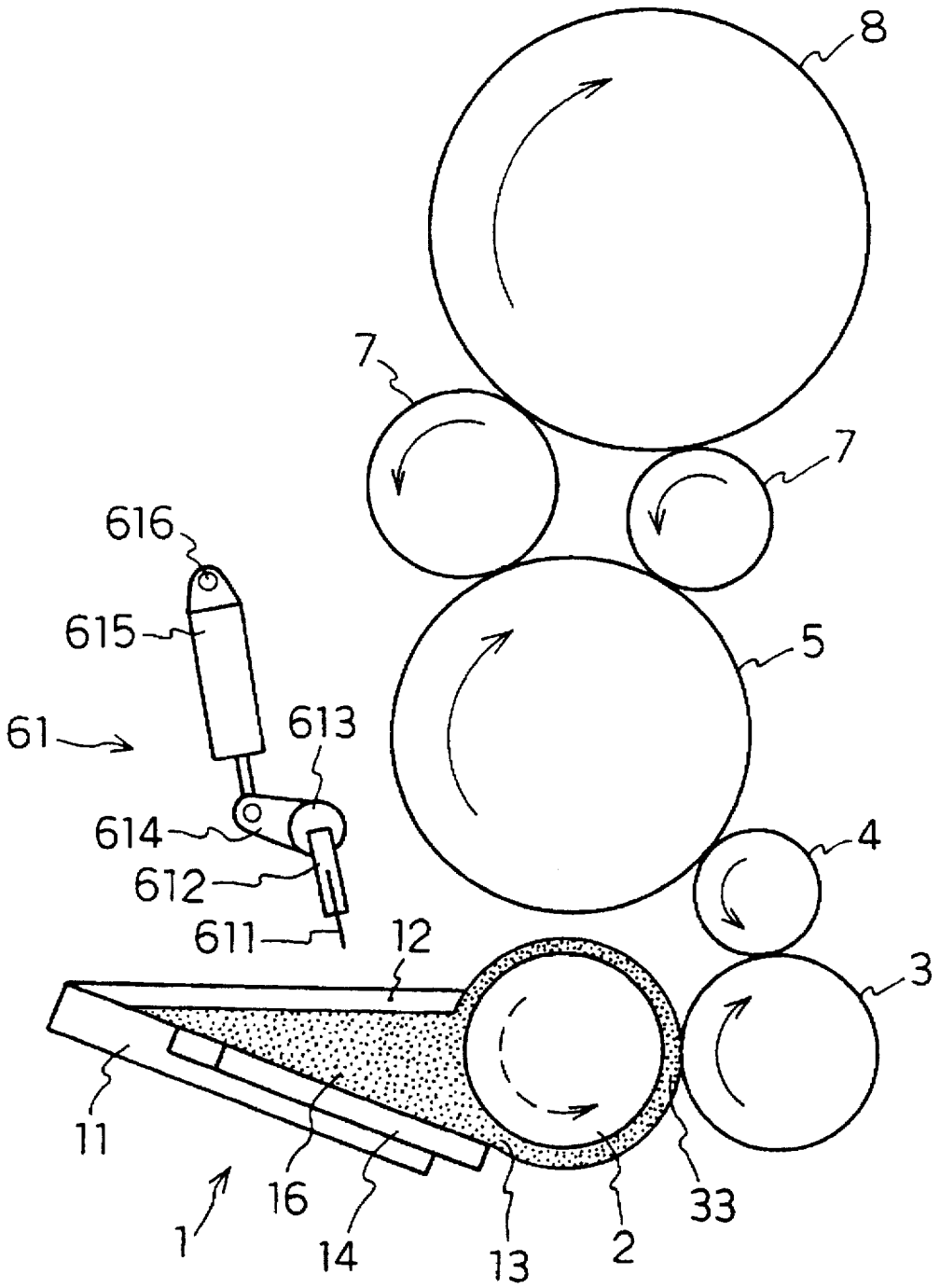
FIG. 14 is a sectional side elevation of the keyless and non-keyless type ink furnishing apparatus of FIG. 13, in non-keyless ink furnishing mode.
Figure 15:
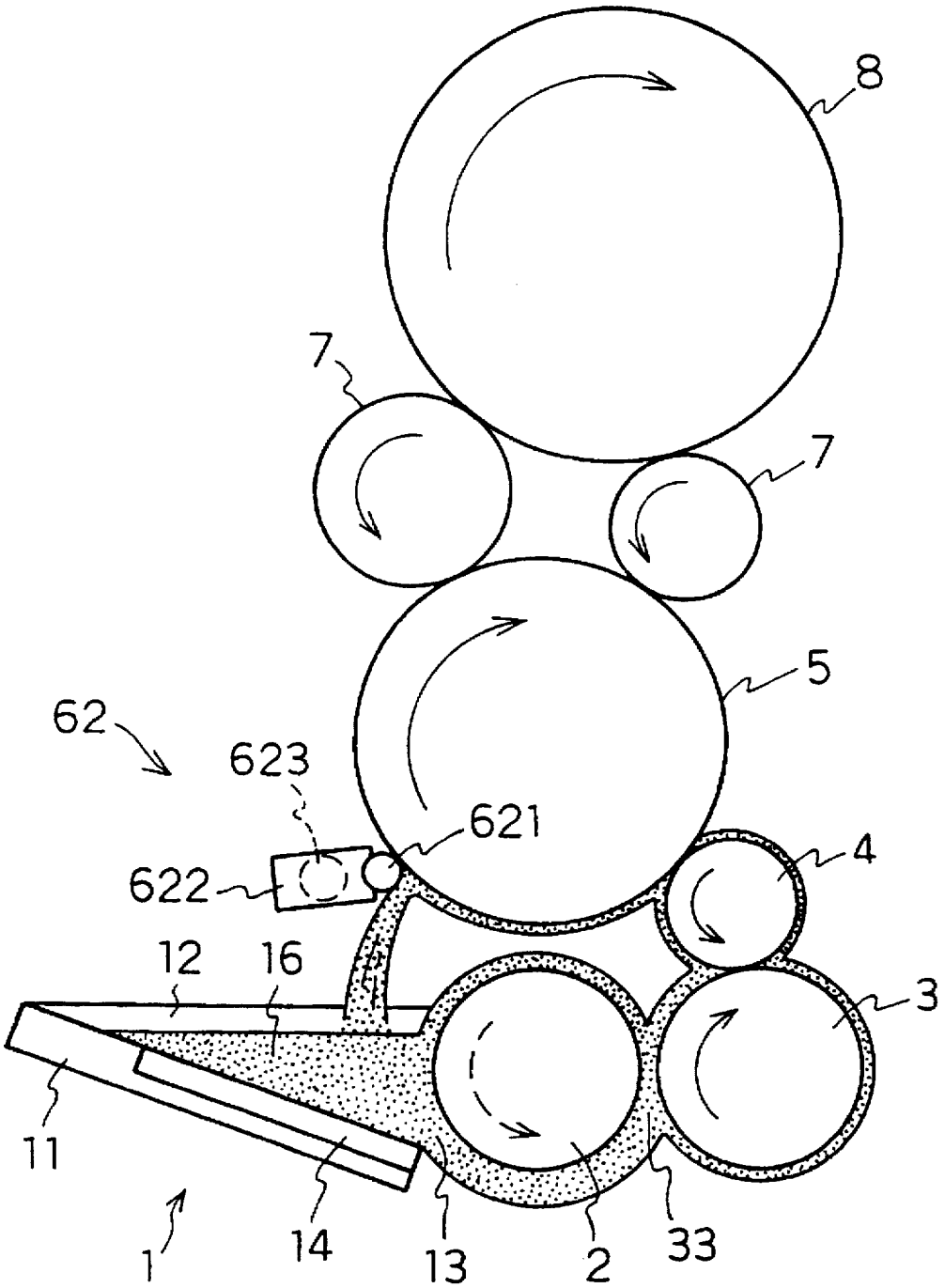
FIG. 15 is a sectional side elevation of an embodiment of keyless and non-keyless type ink furnishing apparatus employing the doctor bar as the doctor means, which is in keyless ink furnishing mode.
Figure 16:
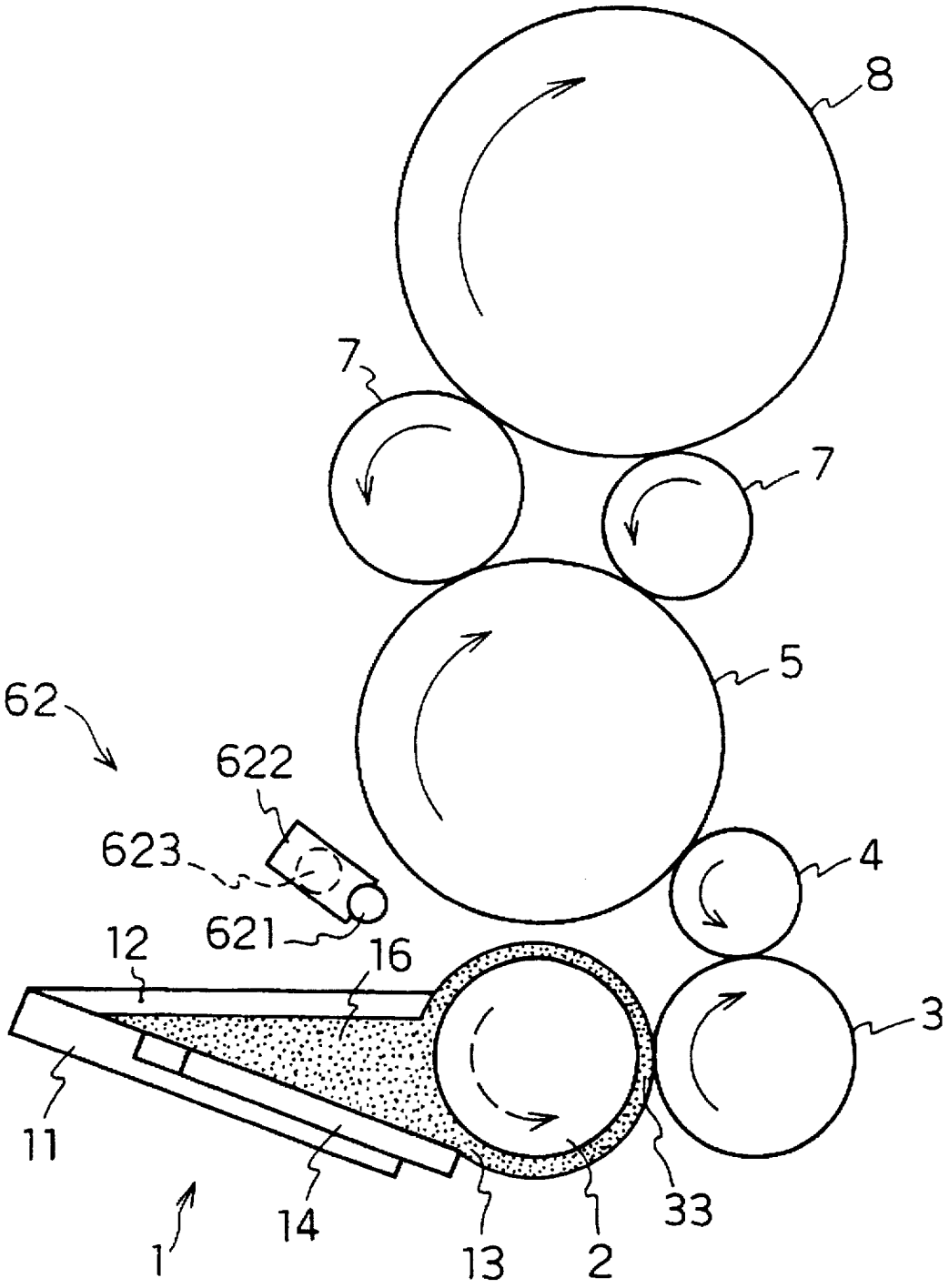
FIG. 16 is a sectional side elevation of the keyless and non-keyless type ink furnishing apparatus of FIG. 15, in non-keyless ink furnishing mode.
Figure 17:
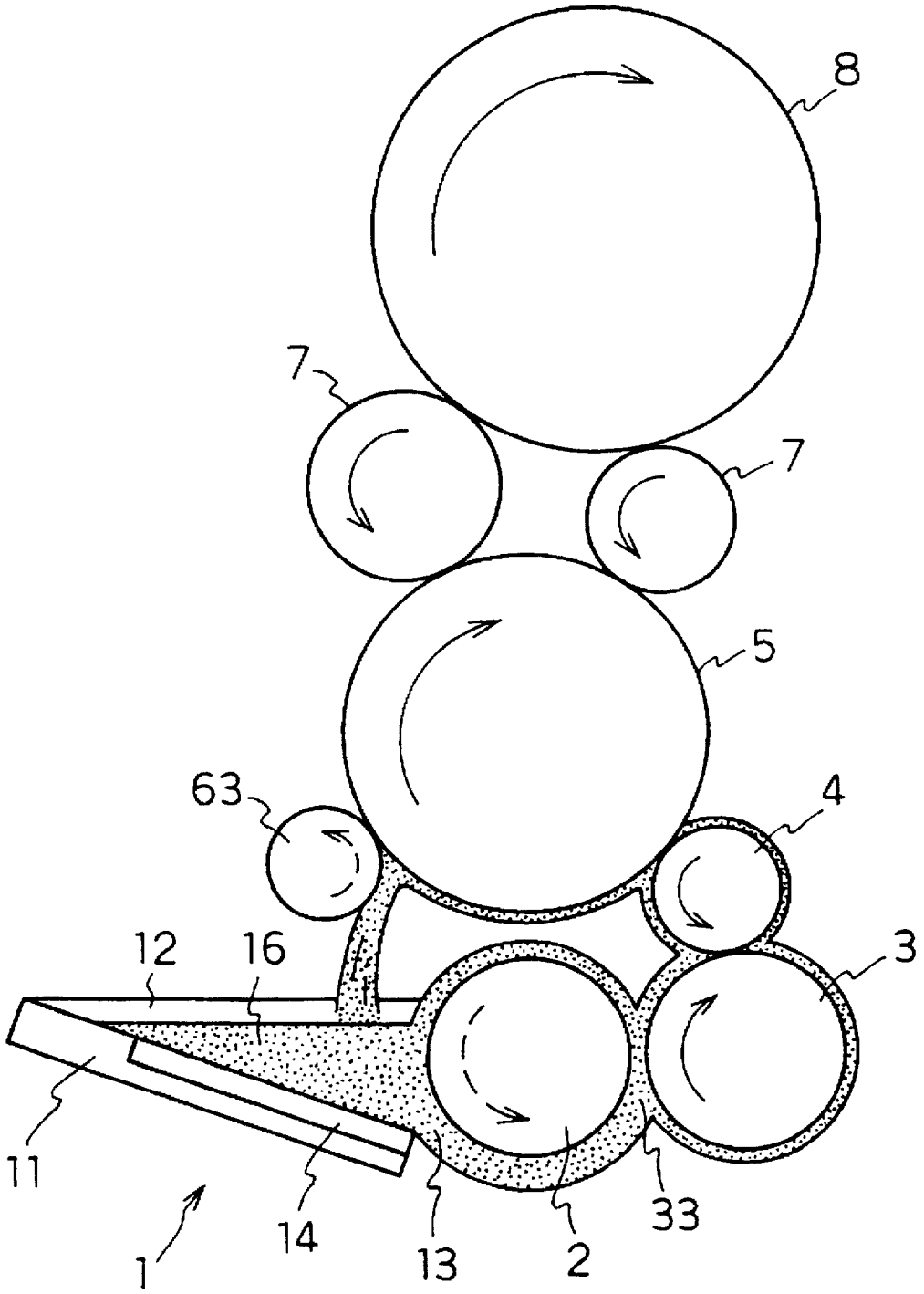
FIG. 17 is a sectional side elevation of an embodiment of keyless and non-keyless type ink furnishing apparatus employing the doctor roller as the doctor means, which is in keyless ink furnishing mode.
Figure 29:
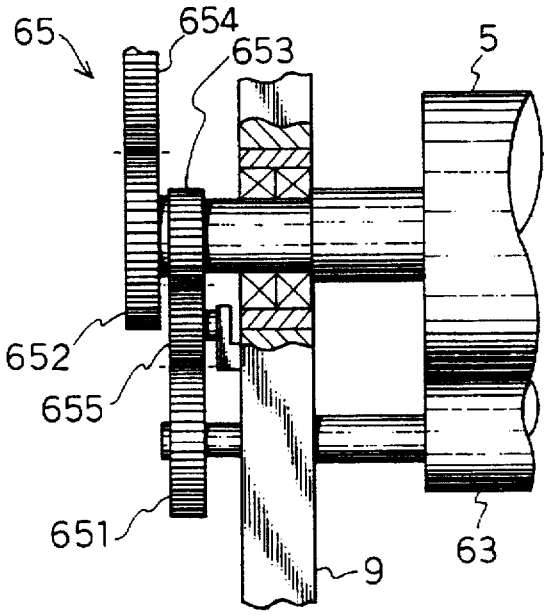
FIG. 29 is a partially sectioned enlarged view of major part of an embodiment of the drive mechanism where the rotating direction of the peripheral surface of the doctor roller becomes opposite to the rotating direction of the peripheral surface of the metering roller in the mode contacting the doctor roller onto the metering roller, in the embodiment of FIGS. 7, 11, 17, 19, 24 and 26.
Figure 30:
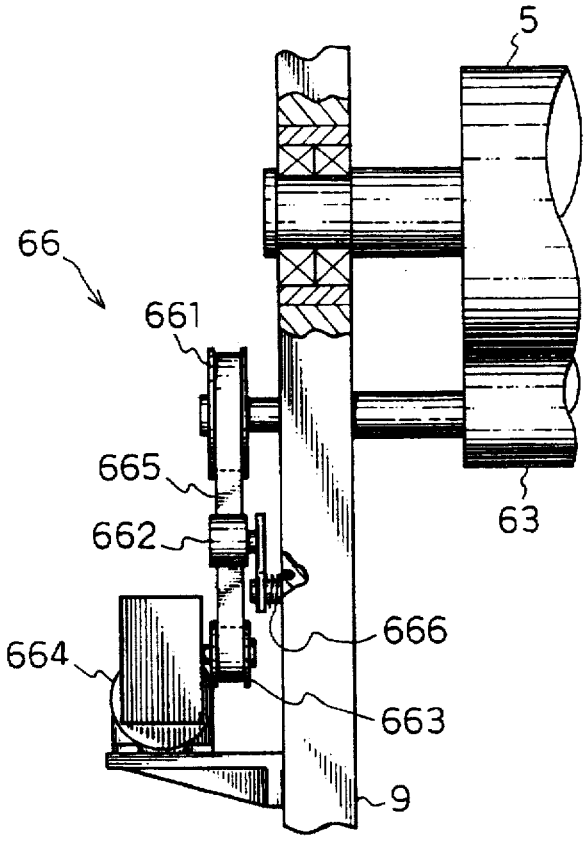
FIG. 30 is a partially sectioned enlarged view of major part of the embodiment of the drive mechanism switchable of rotating direction of the doctor roller to rotate the peripheral surface of the doctor roller in the same and opposite directions relative to the rotating direction of the peripheral surface of the metering roller in the mode contacting the doctor roller onto the metering roller, and variable of the rotation speed, in the embodiment of FIGS. 7, 11, 17, 19, 24 and 26.

The doctor roller 63 is designed to employ various drive mechanism listed hereinafter, corresponding to various printing mode. Namely, as shown in FIG. 12, the doctor roller 63 is provided with the drive mechanism which can rotate the doctor roller 63 at the peripheral speed lower than the peripheral speed of the metering roller 5 so that the peripheral surface of the doctor roller 63 is displaced in the same direction to displacement of the peripheral surface of the metering roller 5, at the contact portion therebetween. As shown in FIGS. 29 and 30, the doctor roller 63 has the drive mechanism which drives the doctor roller 63 to rotate to cause displacement of the peripheral surface in opposite direction to the direction of displacement of the metering roller 5 at the contacting position, irrespective of the peripheral speed.

The drive mechanism 64 shown in FIG. 12 is constructed to transmit a rotation of a transmission gear 643 located at the upstream side in the drive train to a gear 641 at the side of the doctor roller, which gear 641 is mounted on the axial end of the doctor roller 63, via a gear 642 at the side of the metering roller, which gear 642 is mounted on the axial end of the metering roller 5. Thus, the doctor roller 63 is be driven at a speed where the peripheral speed thereof is lower than the peripheral speed of the metering roller 5, and at this time, the driving direction of the doctor roller is the direction for shifting the peripheral surface thereof in the same direction to the shifting direction of the peripheral surface of the metering roller 5 at the contacting point. The doctor roller rotates at lower peripheral speed than the peripheral speed of the metering roller.

On the other hand, a drive mechanism 65 of FIG. 29 is constructed to transmit rotation of a transmission gear 654 positioned at the upstream side of the power train to the gear 651 at the doctor roller side mounted on the axial end of the doctor roller 63 via a first gear 652 at the metering roller side mounted on the axial end of the metering roller, a second gear 653 at the metering roller side integral with the first gear 652 and an intermediate gear 655 rotatably supported on the frame 9 by an appropriate support means. Thus, the doctor roller 63 is driven in a direction to cause the peripheral surface thereof to move in the opposite direction to the peripheral surface of the metering roller 5 at the contacting position irrespective of the peripheral speed.

A drive mechanism 66 shown in FIG. 30 has an independent doctor roller driving source 664 at the upstream side of the drive train. The rotation of the driving source 664 is transmitted to the doctor roller 63 via a transmission belt 665 warped around a pulley 663 at the driving source side and a pulley 661 at the doctor roller side mounted at the axial end of the doctor roller 63.

In the drive mechanism 66, the rotating direction of the doctor roller 62 can be selected by selecting the driving direction of the driving mechanism between forward or reverse directions. Also, the peripheral speed of the doctor roller 63 can be varied by controlling rotation speed of the output shaft of the driving source 664 per unit time. Then, variation of the peripheral speed of the doctor roller 63 enables varying of thickness of the ink passing through the contact portion between the metering roller 5 and the doctor roller 63 utilizing the elastic hydro lubricating phenomenon. Thus, the density of the entire printing surface can be varied. On the other hand, by variation of the rotating direction, the doctor roller 63 can be driven either in a direction for scraping off the ink from the peripheral surface of the metering roller 5 or in a direction for not scraping off. It is desirable to select the material and surface hardness of the doctor roller 63 depending upon the material forming the surface of the metering roller 5.

Also, in case of the driven mechanism 66, it is preferred to employ a cogged belt as the transmission belt 665 and teethed pulleys as the driving source side pulley 663 and doctor roller side pulley 661 so that the cogged belt may engage with the teethed pulleys 663 and 661 for assuring power transmission. Also, it is desirable to provide a tension pulley 662 for removing play of the belt. In further preferred construction, the tension pulley 662 is biased by a spring 666 toward the mating surface of the transmission belt 665 for automatically adjusting the tension of the belt depending upon the magnitude of the play of the belt.

It should be noted that, in the embodiment of FIG. 30, the metering roller 5 is driven by a drive mechanism associated at the axial end of the not shown opposite side.

The form roller 7 is supplied the ink substantially uniformly over the entire length from the peripheral surface of the metering roller 5 scraped off the excess amount of ink. Then, the ink is furnished to the printing plate on the plate cylinder 8 from the form roller 7. It should be noted that the form roller is a roller having a rubber surface layer having a surface hardness of 20 to 40 (Shore A).

The doctor means 6 may be designed for selectively varying the position between a contacting position, in which it contacts with the metering roller and a non-contacting position, namely positioned away from the metering roller 5, if necessary.

As shown in FIGS. 13 and 14 or FIGS. 20 and 21, when the doctor means is the doctor blade 61, the doctor holder 612 carrying the blade 611 is integrally mounted on a holder displacing shaft 613 which is provided on a frame in a condition where angular displacement is permitted. An actuation arm 614 is connected to at least one side of the holder displacing shaft 613. The free end of the actuation arm 614 is connected to an output rod of a hydraulic cylinder as driving source for shifting the blade 611 toward and away from the peripheral surface of the metering roller 5. The hydraulic cylinder 615 is pivotably mounted on a not shown frame by a hydraulic cylinder support shaft 616. Thus, a rotary displacing mechanism for shifting the blade 611 toward and away from the peripheral surface of the metering roller 5 can be constructed.

Next, as shown in FIGS. 15 and 16 or FIGS. 22 and 23, when the doctor means 6 is the doctor bar 62, a stay end shafts 623 are provided at both ends of a back-up stay 622 which carries a bar 621. The back-up stay 622 is thus pivotably supported on the not shown frame. While it is not illustrated, similar rotary displacing mechanism to the case of the doctor blade is associated with at least one side of the stay end shaft 623. Thus, by means of the rotary displacing mechanism, the bar 621 can be shifted toward and away from the peripheral surface of the metering roller 5.

Figure 27:
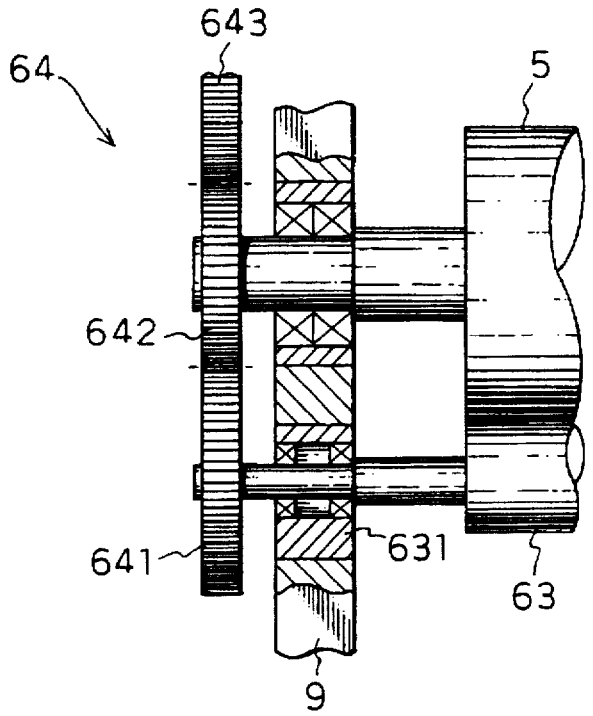
FIG. 27 is a partially sectioned enlarged view of the major part of one example of a drive mechanism of the doctor roller and contacting and releasing means for contacting and releasing the doctor roller to and from the a metering roller, as employed in the embodiments of FIGS. 17, 18, 24 and 25.

When the doctor means 6 is a doctor roller 63 as shown in FIGS. 17 and 18 or FIGS. 24 and 25, the both ends of the doctor roller 63 are supported by the frame 9 via eccentric sleeves 631 (only one is shown) to form a mechanism for shifting the doctor roller 63 toward and away from the metering roller 5, as shown in 27. Namely, by causing angular displacement of the eccentric sleeve 631 relative to a frame 9 by any appropriate means, the doctor roller 63 is shifted between a contacting position (FIGS. 17 and 24) contacting with the peripheral surface of the metering roller 5 and a released position (FIGS. 18 and 25) placed away from the peripheral wall of the metering roller 5. In the alternative embodiment, as shown in FIG. 27, the drive mechanism for driving the doctor roller 63 can be the drive mechanism 64 (FIG. 12), the drive mechanism 66 (FIG. 30), the drive mechanism 65 (FIG. 29) as shown or alternative thereof.

During printing operation, the doctor roller 63 may be brought into contact with the peripheral surface of the metering roller 5. The rotating direction of the doctor roller 63 may be selectively reversed for selecting between a rotating direction for scraping off the ink from the metering roller 5 and a rotating direction for not scraping.

At first, rotation of the doctor roller 63 for scraping off the ink from the metering roller 5 is a rotation to cause a sufficiently large relative peripheral speed difference between the doctor roller 63 and the metering roller 5. The large relative peripheral speed difference can be created by driving the doctor roller 63 to rotate at the lower peripheral speed than the peripheral speed of the metering roller 5, or by driving the doctor roller 63 in a direction to cause the peripheral surface thereof to move in the opposite direction to the peripheral surface of the metering roller 5 at the contacting position. On the other hand, the rotation of the doctor roller 63 for not scraping off the ink from the metering roller 5 is a rotation to cause no or sufficiently small relative peripheral speed difference between the doctor roller 63 and the metering roller 5. This can be achieved at driving the doctor roller 63 in a direction for shifting the peripheral surface thereof in the same direction to the shifting direction of the peripheral surface of the metering roller 5 at the contacting point and at a speed substantially equal to the peripheral speed of the metering roller 5.

Figure 28:
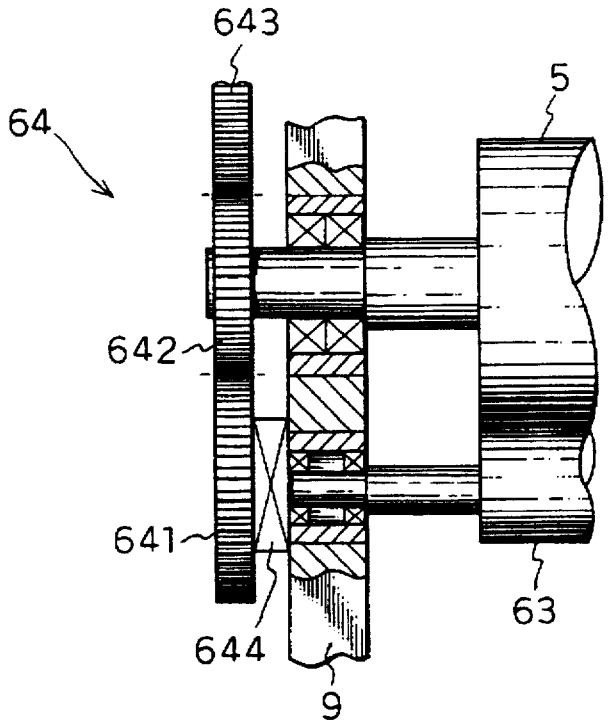
FIG. 28 is a partially sectioned enlarged view of the major part of one example for turning ON and OFF of transmission of a driving power to the doctor roller in a mode contacting the doctor roller onto the metering roller, namely the embodiment for rotating the doctor roller following to rotation of the metering roller, in the embodiment of FIGS. 19 and 26.

As shown in FIG. 28, the mechanism for selectively varying the rotation of the doctor roller 63 is constructed by providing an electromagnetic clutch 644 between the gear 641 at the doctor roller side and the doctor roller 63 to switch between the condition for transmitting the rotation transmitted to the gear 641 at the doctor roller side by the electromagnetic clutch 644 and the condition where the doctor roller 63 is completely disconnected from the drive mechanism 64.

Figure 18:
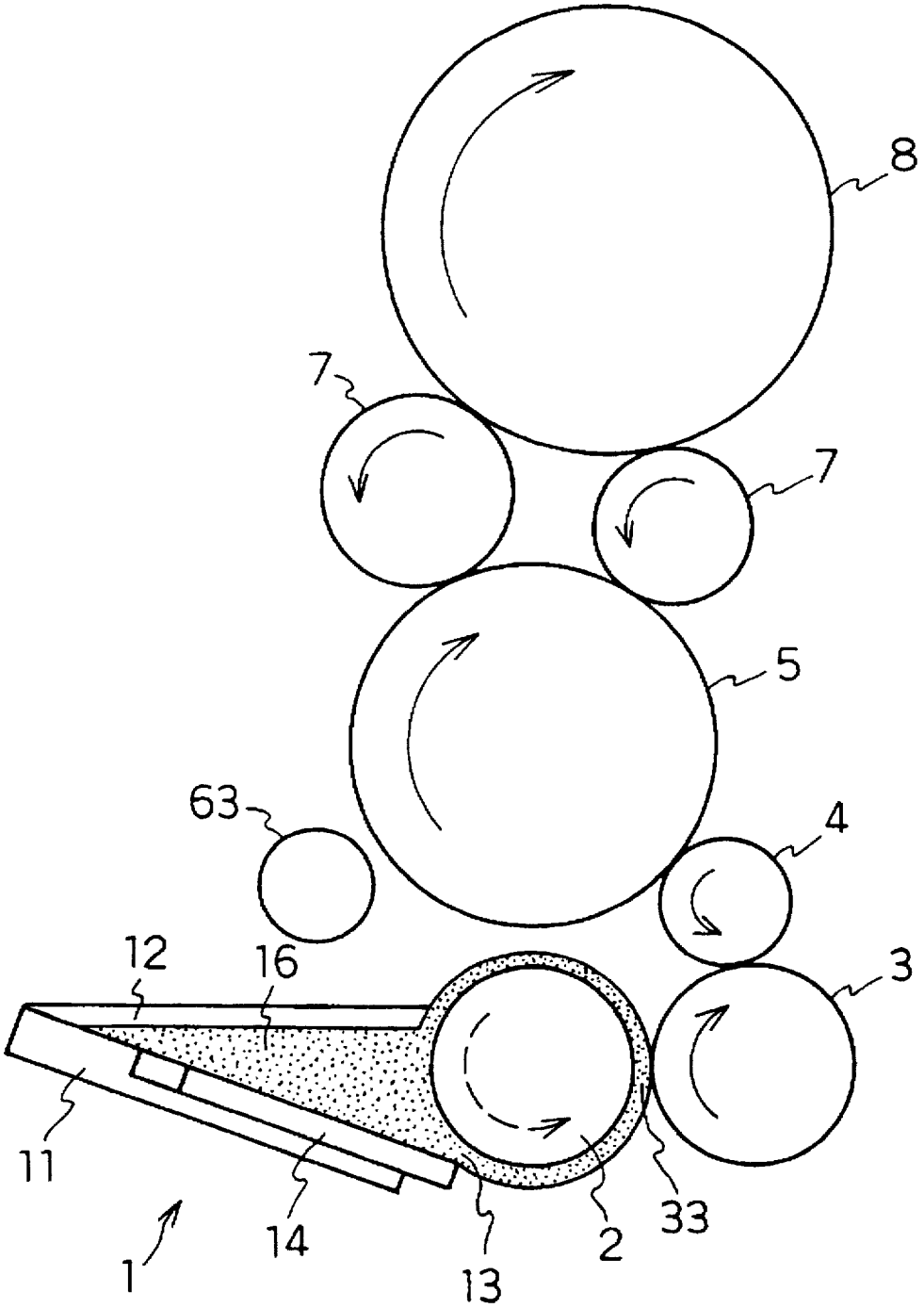
FIG. 18 is a sectional side elevation of the keyless and non-keyless type ink furnishing apparatus of FIG. 17, in non-keyless ink furnishing mode.
Figure 19:
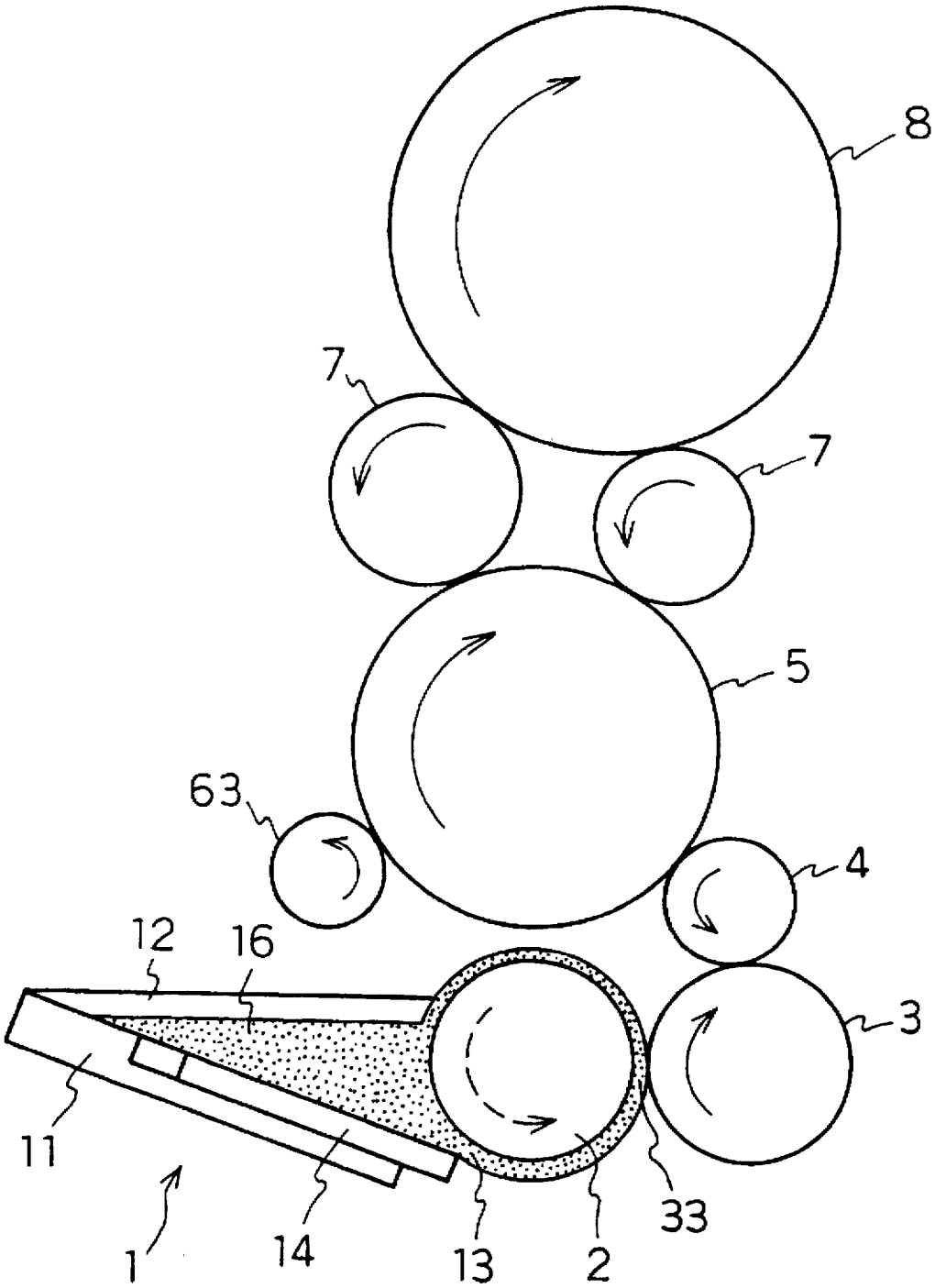
FIG. 19 is a sectional side elevation of the keyless and non-keyless type ink furnishing apparatus of FIG. 17, in non-keyless ink furnishing mode.
Figure 20:
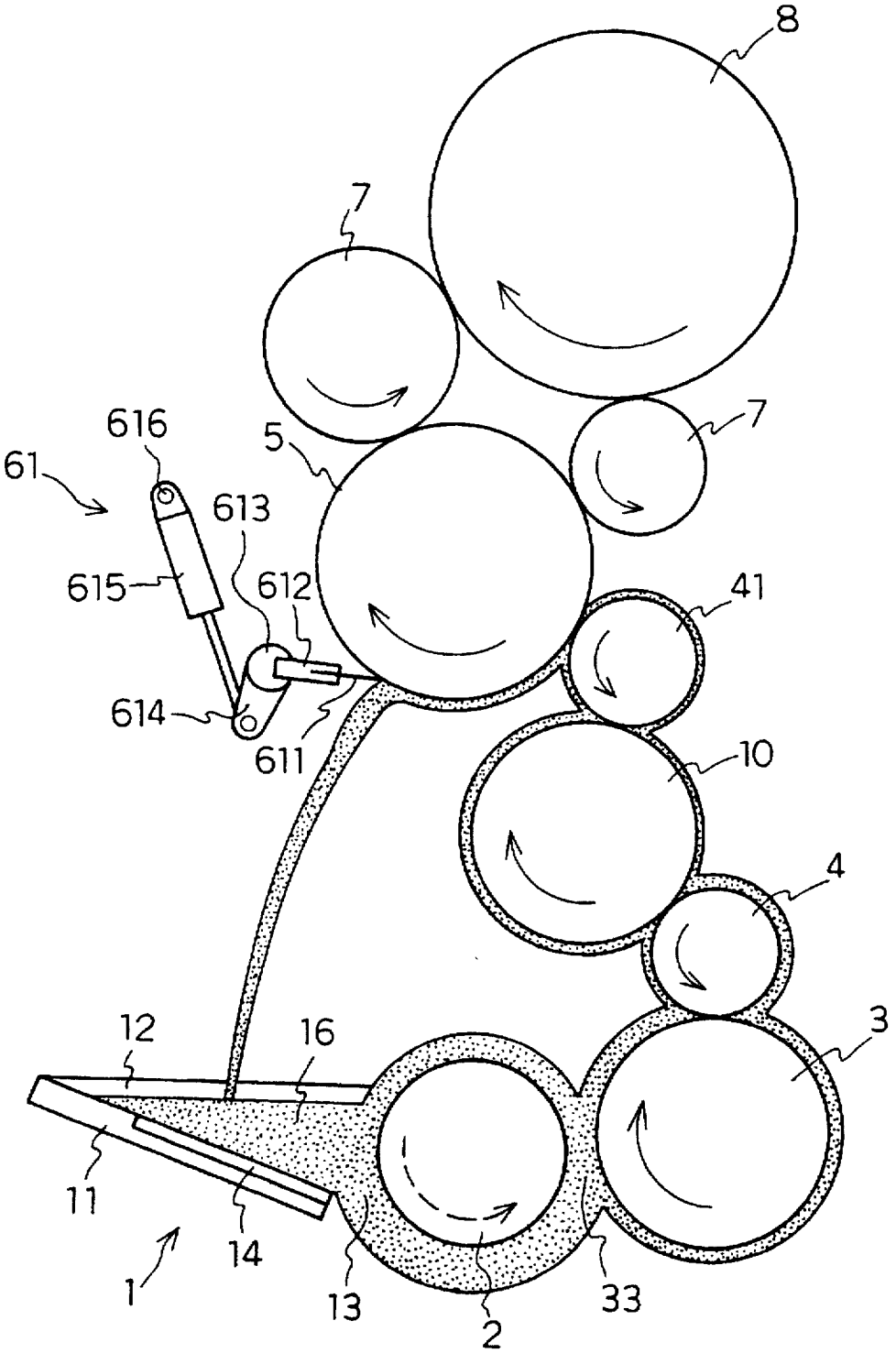
FIG. 20 is a sectional side elevation of an embodiment of keyless and non-keyless type ink furnishing apparatus employing the doctor blade as the doctor means, which is in keyless ink furnishing mode.
Figure 21:
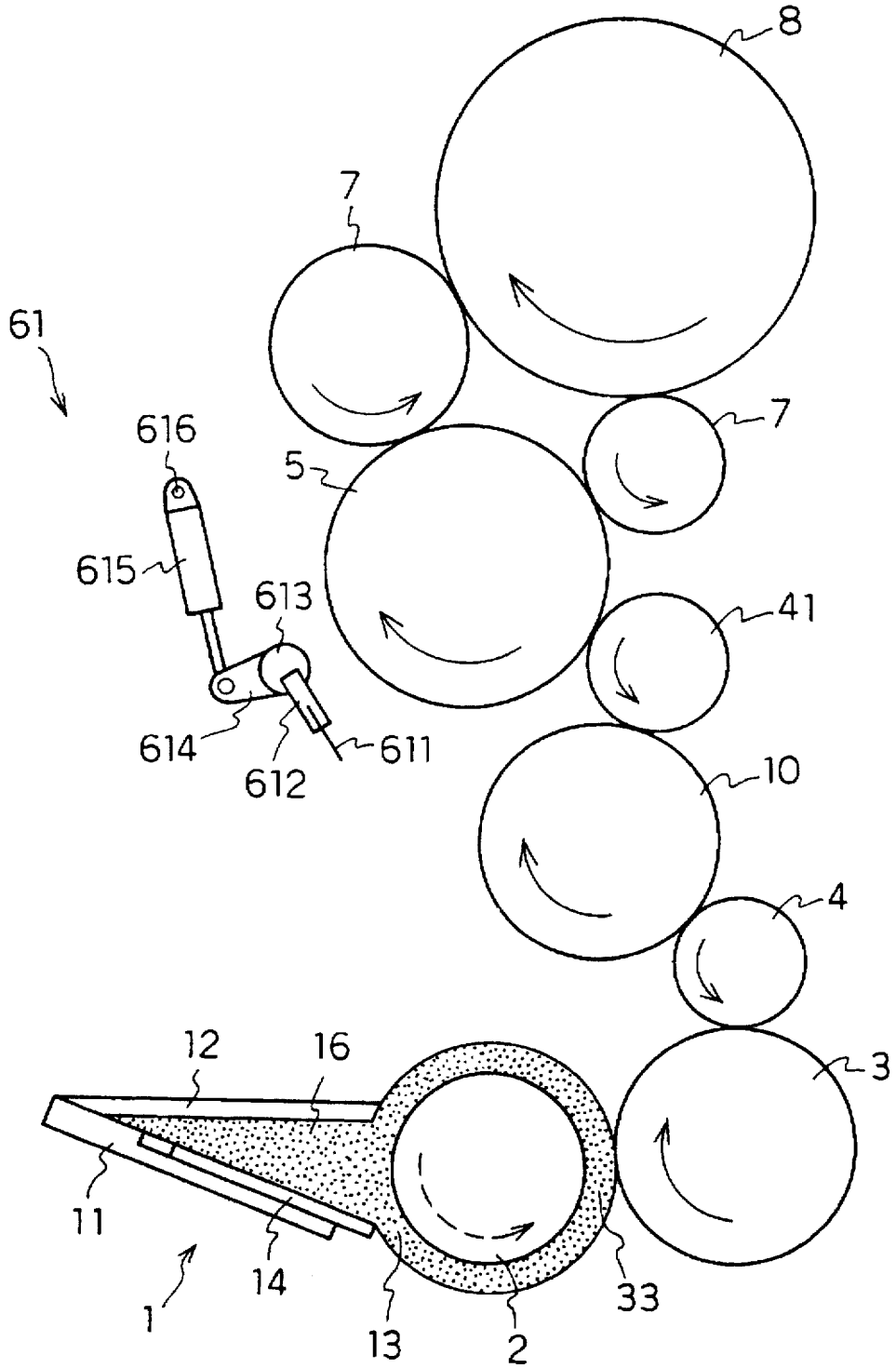
FIG. 21 is a sectional side elevation of the keyless and non-keyless type ink furnishing apparatus of FIG. 20, in non-keyless ink furnishing mode.
Figure 22:
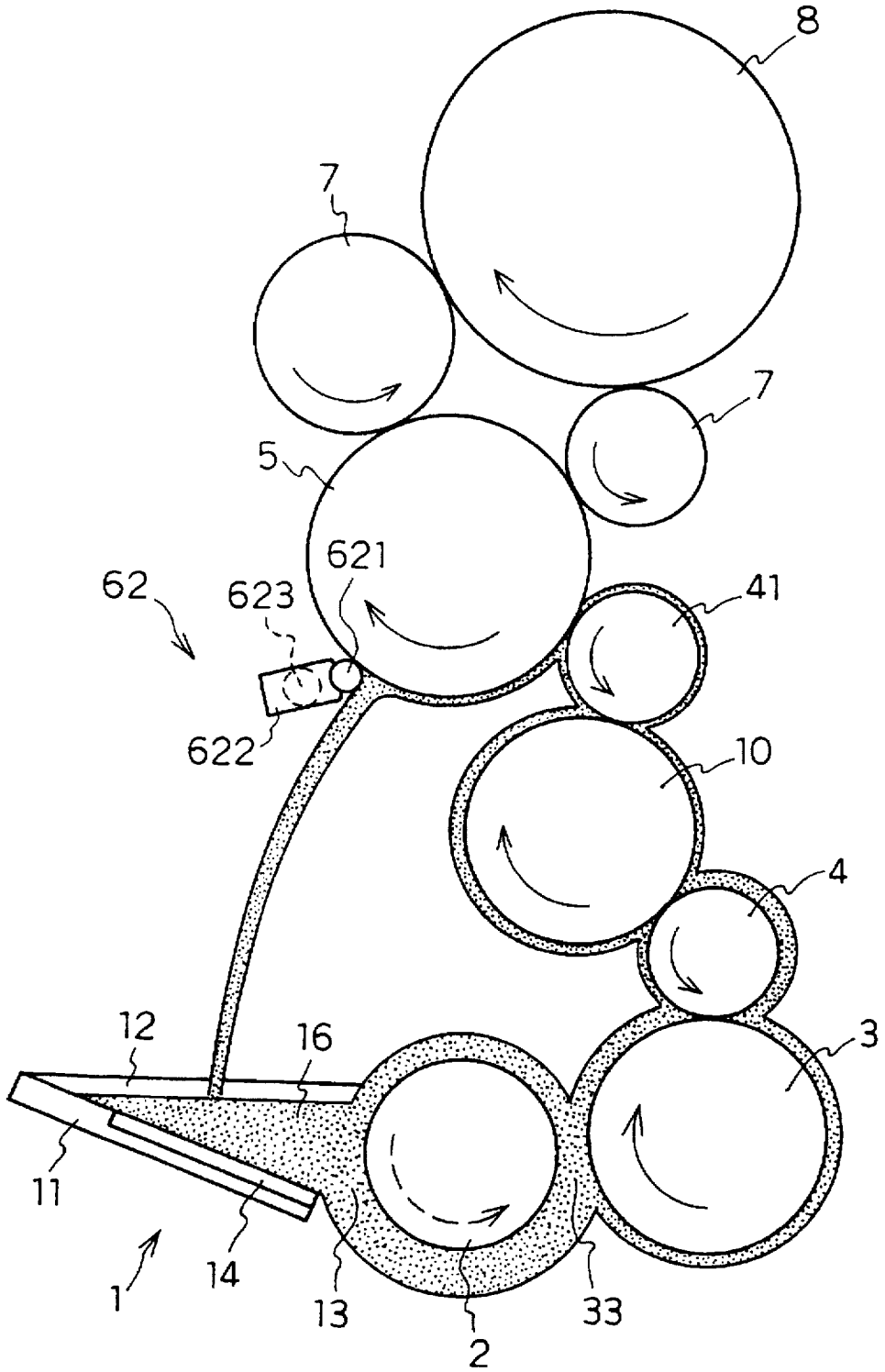
FIG. 22 is a sectional side elevation of an embodiment of keyless and non-keyless type ink furnishing apparatus employing the doctor bar as the doctor means, which is in keyless ink furnishing mode.
Figure 23:
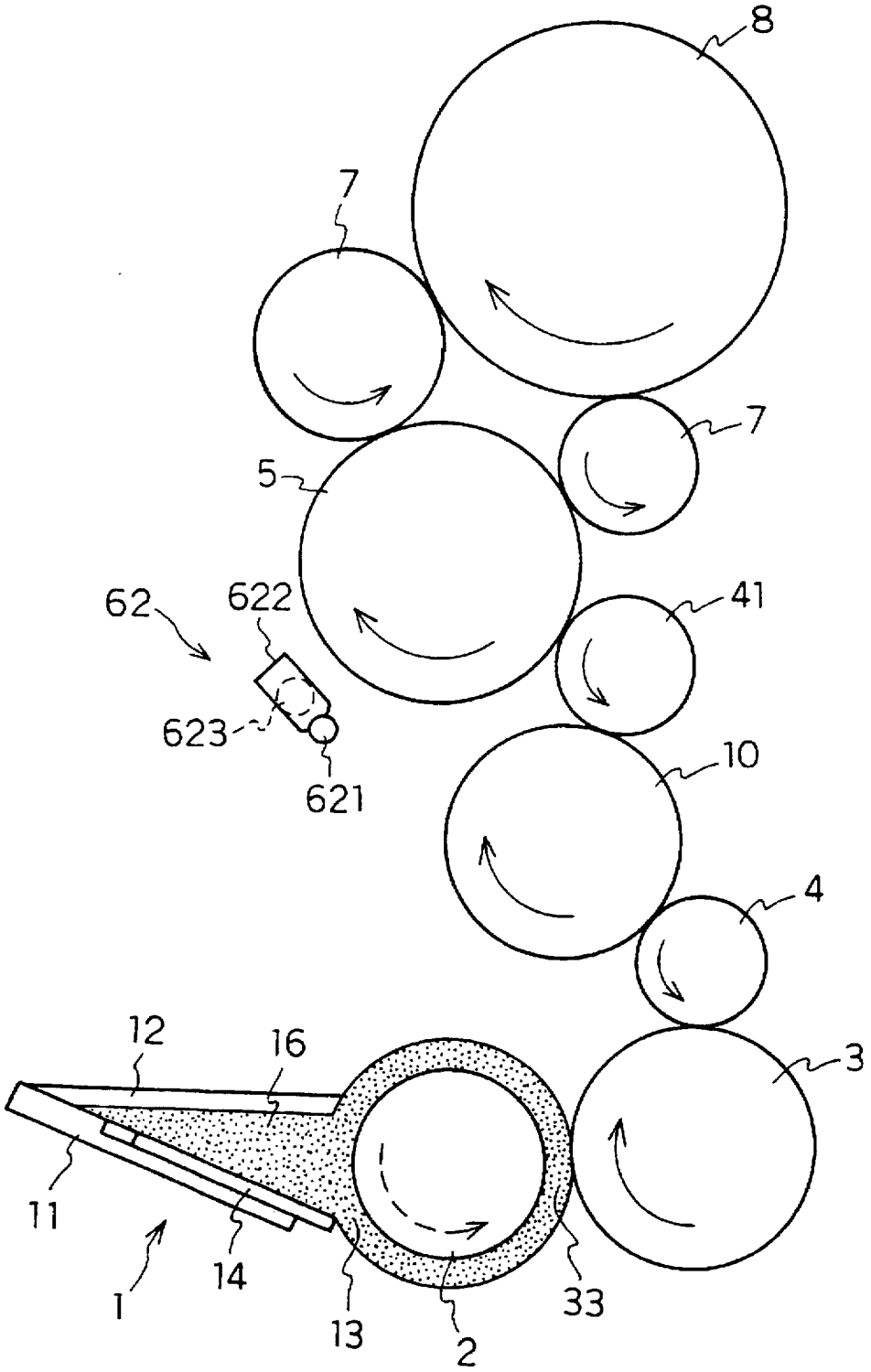
FIG. 23 is a sectional side elevation of the keyless and non-keyless type ink furnishing apparatus of FIG. 22, in non-keyless ink furnishing mode.
Figure 24:
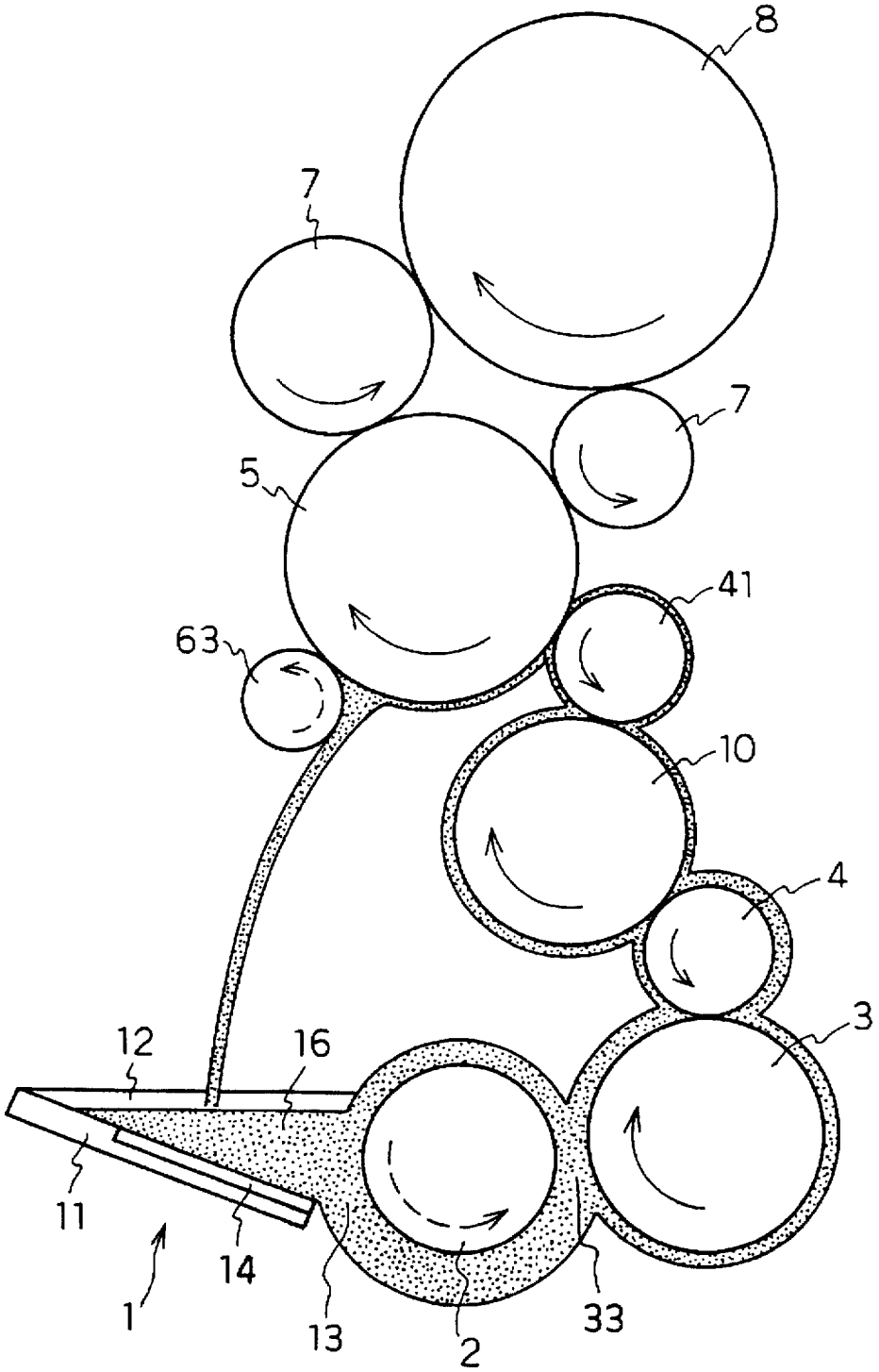
FIG. 24 is a sectional side elevation of an embodiment of keyless and non-keyless type ink furnishing apparatus employing the doctor roller as the doctor means, which is in keyless ink furnishing mode.
Figure 25:
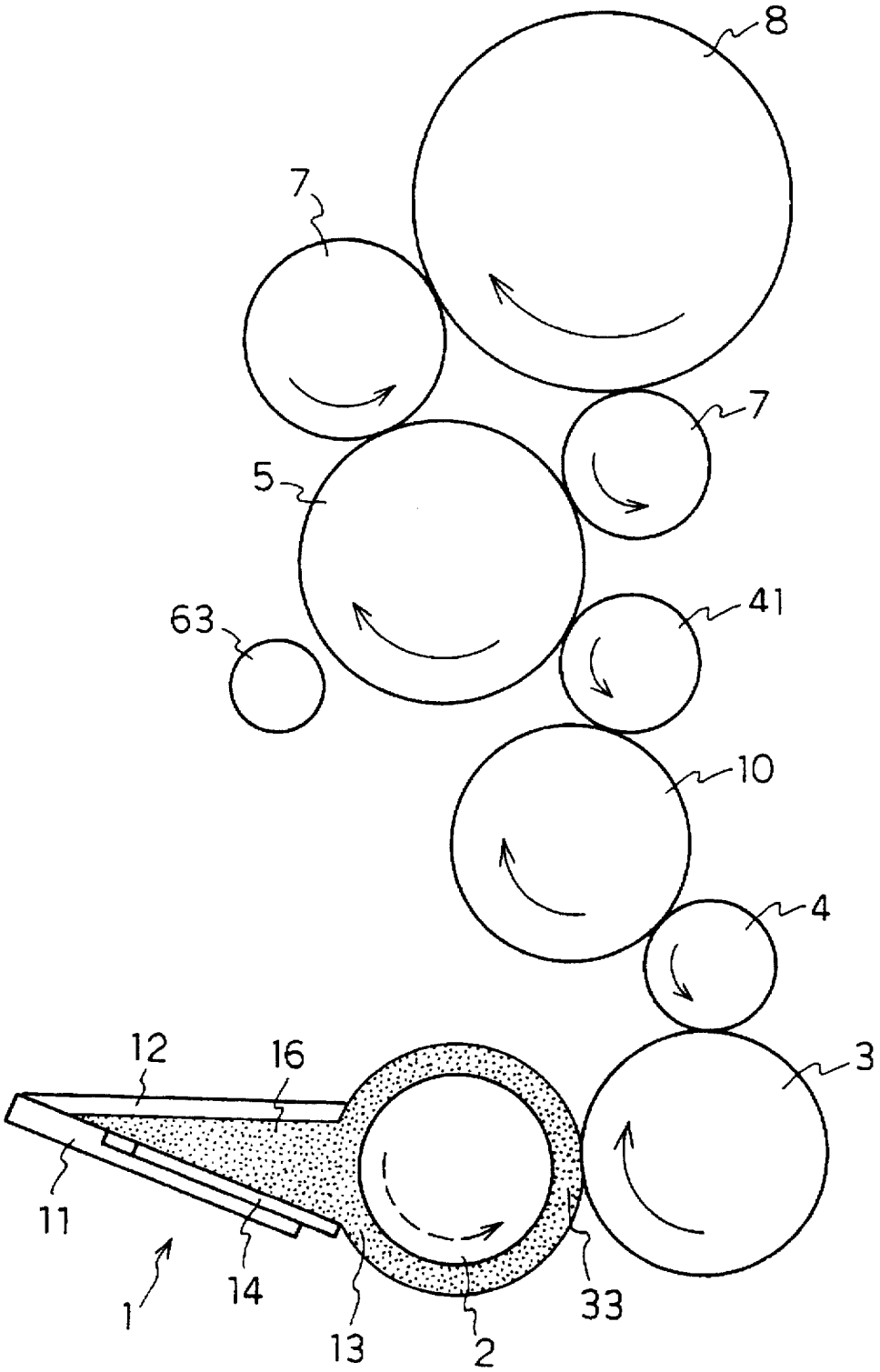
FIG. 25 is a sectional side elevation of the keyless and non-keyless type ink furnishing apparatus of FIG. 24, in non-keyless ink furnishing mode.
Figure 26:
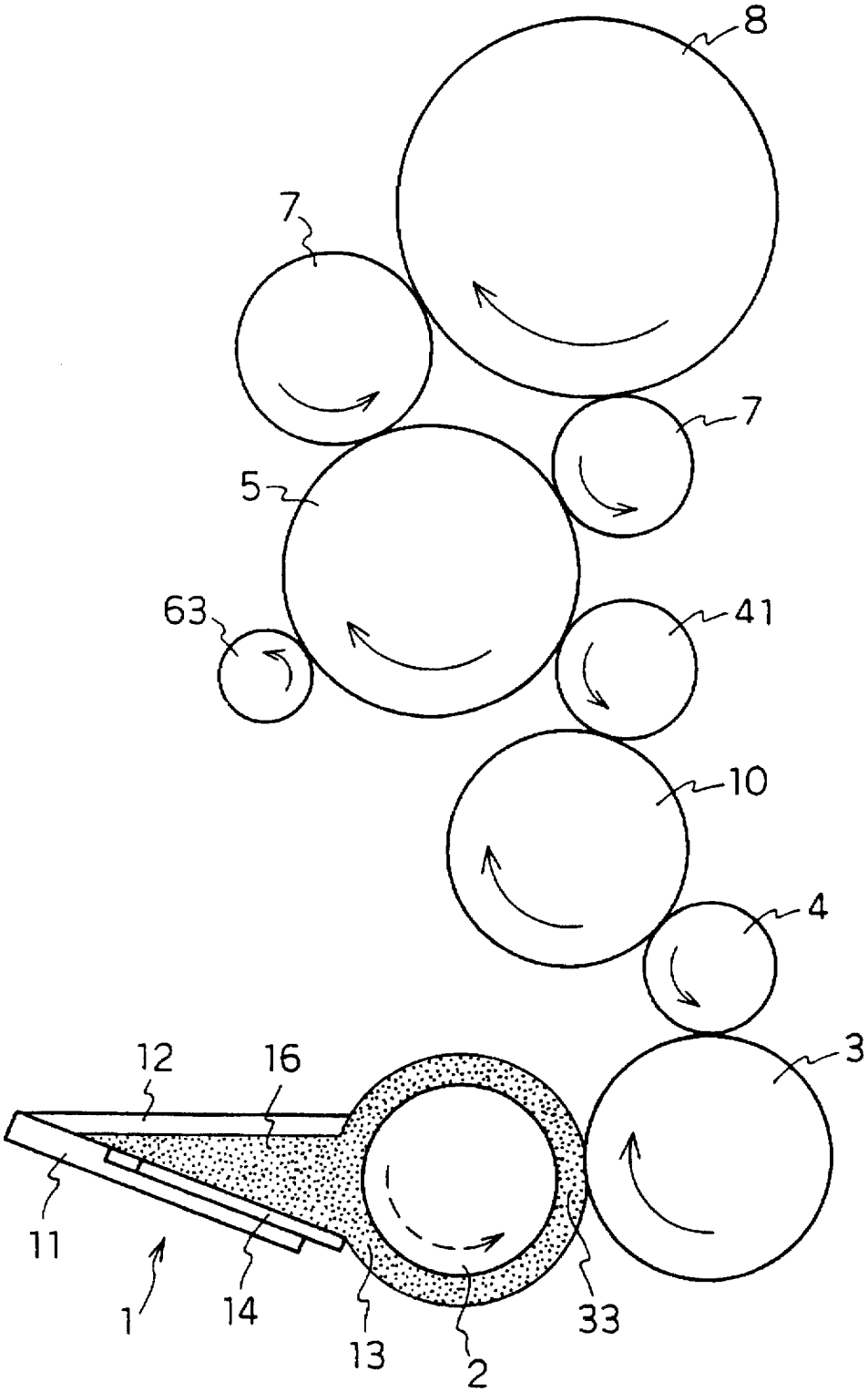
FIG. 26 is a sectional side elevation of the keyless and non-keyless type ink furnishing apparatus of FIG. 24, in non-keyless ink furnishing mode.

The similar mechanism can be constructed in the drive mechanism 66 shown in FIG. 30 or in the drive mechanism 65 in FIG. 18.

On the other hand, in the drive mechanism 66 shown in FIG. 30, as set forth above, by appropriately setting to the rotation speed of the driving source 664 per unit period for switching, the rotation of the doctor roller can be varied between the rotation to scrape off the ink from the metering roller 5 and the rotation not scraping off.

In respective embodiments set forth above, when printing required a normal level of printing quality is to be performed, namely printing by the keyless ink furnishing is to be performed, the first gap 13 between the base 11 of the ink fountain 1 or the divided adjusting plate 141 so as to make the first gap 13 maximum, and the doctor means 4 is brought into contact with the peripheral surface of the metering roller 5, as shown in FIGS. 5 to 7 and 9 to 11. When the doctor means 6 is the doctor roller 63, the rotation of the doctor roller 63 is selected so as to make the relative peripheral speed between the doctor roller 63 and the metering roller 5 sufficiently large to scrape off the ink from the peripheral surface of the metering roller 5 for performing printing operation.

On the other hand, when high level printing quality is required or when the printing image is present only in a partial region in the axial direction of the plate cylinder 8, printing with the non-keyless ink furnishing is performed. Namely, as shown in FIGS. 13 to 19 and 20 to 26, by means of the first gap adjusting means 14, the positions of the divided adjusting plates 141 are adjusted toward and way from the peripheral surface of the fountain roller 2. Then, the sizes of the first gap 13 defined between the tip ends of the divided adjusting plates 141 and the peripheral surface of the fountain roller 2 are adjusted adapting to the distribution of the image of the printing plate on the plate cylinder 8 in respective of divided zones divided in the axial direction of the plate cylinder 8 so that desired amount of ink can be drawn therethrough. On the other hand, the doctor means 6 is moved away from the peripheral surface of the metering roller 5, or when the doctor means 6 cannot be moved away from the peripheral surface of the metering roller 5, the rotation of the doctor roller 63 is selected so as not to scrape off the ink from the peripheral surface of the metering roller 5, to perform printing operation.

Figure 32:
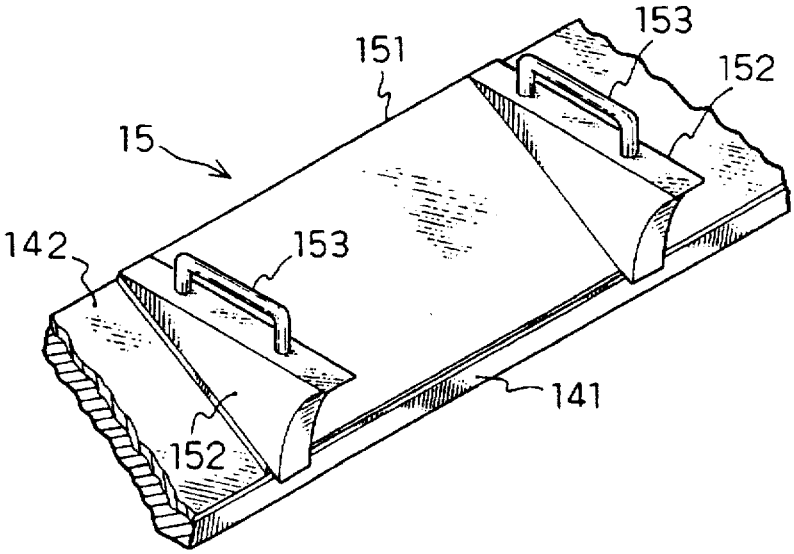
FIG. 32 is a perspective view showing one embodiment of a partitioning means for dividing the ink fountain in the ink furnishing apparatus and using a part of the same.

In the alternative, it is possible that when the printing image is locally present on the plate cylinder 8 in the axial direction, printing may be performed with non-keyless ink furnishing in the following manner. As shown in FIG. 32, an ink fountain partitioning means 15 is installed in the ink fountain 1 at the portion aligning with the region of the printing image on the printing plate. Then, only for the portion defined by the ink fountain partitioning means 15, the ink is stored to perform printing operation. With such arrangement, the regions of the rollers and cylinders, on which the ink is deposited, is limited to reduce wasting of the ink. In conjunction therewith, cleaning after printing operation has to be facilitated for smaller area to be cleaned.

The ink fountain partitioning means 15 comprises a partitioning bottom plate 151, partitioning side plates 152 and a handle 153 to facilitate handling of the ink fountain partitioning means 15. At the front sides, the partitioning side plates 152 are formed with unevenness complementary with the peripheral surface of the fountain roller 2 so that the partitioning side plates 152 tightly contact with the peripheral surface of rotating fountain roller 2. The uneven surface of the side plates 152 is formed with a material having low hardness, such as a synthetic resin or lead or so forth, so as not to damage the peripheral surface of the fountain roller 2. On the other hand, the partitioning bottom plate 151 is set so as not to narrow the maximum open area of the first gap 13 between the divided adjusting plate 141 and the fountain roller 2 when the ink fountain partitioning means 15 is tightly fitted on the ink fountain 1. The distance between the opposing side walls 152 is selected to be slightly wider than the region of the printing image on the printing plate.

It should be noted that, in the keyless furnishing, upon scraping off the ink from the metering roller 5 by means of the doctor means 4, the frictional force between the doctor means 4 and the metering roller 5 can be varied significantly depending upon presence or absence of the ink to cause uneven wearing on the metering roller 5. Therefore, it is not possible to ink furnishing employing the ink fountain partitioning means 15.

The ink furnishing apparatus according to the present invention is successful to certainly and smoothly furnish the high viscous ink to the plate surface of the plate cylinder by providing a mechanism to promote a phenomenon to temporarily softening of the high viscous ink, namely the phenomenon to temporarily increase flow ability of the high viscous ink, in the ink furnishing path from the ink fountain 1 to the metering roller. That is, according to the shown construction of the present invention, the high viscous ink is drawn through the first gap defined between the front edge of the base of the ink fountain and the fountain roller, carried on the peripheral surface of the fountain roller downwardly. Then, the high viscous ink is extended to be the thickness corresponding to the width of the first gap. By extension upon drawn out from the ink fountain, an external force is exerted on the high viscous ink to cause first stage softening. Also, upon transferring of the ink from the peripheral surface to the uneven surface roller through the second gap which is smaller than the first gap, the peripheral speed of the uneven surface roller is set at higher than the peripheral speed of the fountain roller to forcedly compress the ink to cause disruption to further promote temporary softening of the ink. In case of the first embodiment, by contact between the uneven surface roller and the intermediate roller and between the intermediate roller and the metering roller, compression and disruption of the ink is further repeated to further soften the ink to make ink to be easily received within the fine ink receptacle cavities on the surface of the metering roller. On the other hand, in case of the second embodiment, by contact between the uneven surface roller and the first intermediate roller, between the first intermediate roller and the ink cylinder and between the ink cylinder and the second intermediate roller, compression and disruption of the ink is further repeated to further soften the ink to make ink to be easily received within the fine ink receptacle cavities on the surface of the metering roller. Furthermore, when the ink cylinder is oscillated in the axial direction, by expansion of the ink in the axial direction at the contact portions between the peripheral surface of the ink cylinder and the first and second intermediate rollers, the ink can be further sufficiently fluidized to be satisfactorily supplied to the peripheral surface of the metering roller. Thus, the high viscous ink which has been difficult to deposite in the fine ink receptacle cavities of the metering roller for high viscosity in the prior art, can be easily deposited in the fine ink receptacle cavities by repeated application of the external force for providing sufficient fluidity. Therefore, the high viscous ink which has been difficult to furnish, can be certainly, smoothly and continuously furnished.

Furthermore, the present invention facilitates furnishing of the high viscous ink opens the gate for multi-functioning of printing modes. Namely, the invention functions as facility corresponding to normal quality printing on one hand, and also functions as facility for high quality printing to form a multi-function type printing press.

At first, as facility corresponding to the normal quality printing, when the uniform printing over the entire surface by the keyless ink furnishing, with respect to the adjusting means for the first gap provided in the ink fountain, necessity can be avoided, or, in the alternative, the adjusting means is used to constantly place the first gap in the fully open condition. On the other hand, concerning switching of the doctor means including the doctor blade, doctor bar and the doctor roller, necessity of switching means is avoided to constantly contact the doctor means on the peripheral surface of the metering roller, or, in the alternative, the switching means is employed for switching between ink scraping mode and non-scraping mode. In the latter case and when the doctor means is the doctor roller, switching between the ink scraping mode and non-scraping mode is realized by adjusting relative peripheral speed between the doctor roller and the metering roller. This can be achieved by driving the doctor roller at lower peripheral speed than the metering roller or in the alternative by driving the doctor roller to cause displacement of the peripheral surface of the doctor roller in opposite direction to that of the metering roller in the ink scraping mode and by driving the doctor roller at equal peripheral speed and the same direction to those of the metering roller.

Next, as the facility corresponding to high quality printing, when partial printing mode with the non-keyless ink furnishing is desired, the adjusting means for the first gap provided in the ink fountain is actuated to adjust the open areas of respective divided zones depending upon demand of ink furnishing amount at respectively corresponding printing regions, and, in conjunction therewith the doctor means including the doctor blade, the doctor bar and the doctor roller is switched to release from the metering roller or to adjust the relative peripheral speed relative to that of the metering roller to zero or sufficiently small in case of the doctor roller, so as not to scrape off the ink on the metering roller. This can be achieved by driving the doctor roller at equal peripheral speed and the same direction to those of the metering roller.

Furthermore, the present invention includes the ink furnishing apparatus having the ink cylinder and the first and second intermediate rollers contacting with the peripheral surface of the ink cylinder. When such ink furnishing apparatus is applied for the printing press using the dampening water, and surge flow of the dampening water is caused to penetrate into the mechanism set forth above, formation of thin film of dampening water is significantly promoted owing to development of the ink in the axial direction by compression and split by contact between the cylinder and the roller, and oscillation of the ink cylinder. In conjunction therewith, due to head generated by repeated elastic deformation of the first and second intermediate rollers having rubber layers on the peripheral surfaces, the dampening water is heated to evaporate. Thus, the penetrated water can be effectively removed.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain; and an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

whereby said ink furnishing apparatus operating in such a manner that the ink drawn from said ink fountain by rotation of said fountain roller and having a thickness corresponding to said first gap is supplied to the peripheral surface with compression by passing through said second gap, is provided fluidity by compression and disrupture through contact between the peripheral surfaces of said uneven surface roller and said intermediate roller and contact between the peripheral surfaces of said intermediate roller and said metering roller for supplying to the peripheral surface of said metering roller, the excess amount of ink on the peripheral surface of said metering roller is scraped off by said doctor means and returned to said ink fountain for supplying substantially uniform amount of ink at any axial position of said metering roller to a printing plate on a plate cylinder via the peripheral surface of said form roller.

2. An ink furnishing apparatus as set forth in claim 1, wherein said fine recesses of said metering roller are cavities regularly arranged on the peripheral surface.

3. An ink furnishing apparatus as set forth in claim 1, wherein said fine recesses of said metering roller are recesses opening the peripheral surface, in which hollow portions uniformly distributed an outer periphery are opened to the peripheral surface.

4. An ink furnishing apparatus as set forth in claim 1, wherein said doctor means is a doctor blade.

5. An ink furnishing apparatus as set forth in claim 1, wherein said doctor means is a doctor bar.

6. An ink furnishing apparatus as set forth in claim 1, wherein said doctor means is a doctor roller rotating at lower peripheral speed than that of said metering roller.

7. An ink furnishing apparatus as set forth in claim 1, wherein said doctor means is a doctor roller rotating at opposite direction to cause shifting of the peripheral surface in a direction opposite to the shifting direction of the peripheral surface of said metering roller, at the contact positions.

8. An ink furnishing apparatus as set forth in claim 1, wherein the unevenness of said uneven surface roller comprises a plurality of projections regularly surrounded by the grooves in the circumference thereof.

9. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller, said doctor means including means for selectively switching the position of the doctor means between a position contacting with the peripheral surface of said metering roller and a position released away from the peripheral surface of said metering roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain; and first gap adjusting means separately provided in said ink fountain for respective of divided zones defined along axial direction of said fountain roller for adjusting said first gap, an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

said apparatus being selectively operable in:

an entire surface ink furnishing mode, in which said first gap is held fully opened, said doctor means is placed in contact with said metering roller, the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said intermediate roller and contact between the peripheral surfaces of said intermediate roller and said metering roller for supplying to the peripheral surface of said metering roller, the excess amount of ink on the peripheral surface of said metering roller is scraped off by said doctor means and returned to said ink fountain for supplying substantially uniform amount of ink at any axial position of said metering roller to a printing plate on a plate cylinder via the peripheral surface of said form roller, and a local ink furnishing mode, in which said first gap is adjusted to be narrower to the necessary size with respect to separated zones by adjusting means, said doctor means being released away from the peripheral surface of said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said intermediate roller and contact between the peripheral surfaces of said intermediate roller and said metering roller for supplying to the peripheral surface of said metering roller and thus supplying the ink supplied on said metering roller to a printing plate on a plate cylinder via the peripheral surface of said form roller.

10. An ink furnishing apparatus as set forth in claim 9, wherein said fine recesses of said metering roller are cavities regularly arranged on the peripheral surface.

11. An ink furnishing apparatus as set forth in claim 9, wherein said fine recesses of said metering roller are recesses opening the peripheral surface, in which hollow portions uniformly distributed an outer periphery are opened to the peripheral surface.

12. An ink furnishing apparatus as set forth in claim 9, wherein said doctor means is a doctor blade.

13. An ink furnishing apparatus as set forth in claim 9, wherein said doctor means is a doctor bar.

14. An ink furnishing apparatus as set forth in claim 9, wherein said doctor means is a doctor roller rotating at lower peripheral speed than that of said metering roller.

15. An ink furnishing apparatus as set forth in claim 9, wherein said doctor means is a doctor roller rotating at opposite direction to cause shifting of the peripheral surface in a direction opposite to the shifting direction of the peripheral surface of said metering roller, at the contact positions.

16. An ink furnishing apparatus as set forth in claim 9, wherein the unevenness of said uneven surface roller comprises a plurality of projections regularly surrounded by the grooves in the circumference thereof.

17. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

an intermediate roller rotating with contacting a peripheral surface thereof with the upstream side of the peripheral surface of said metering roller in the direction of ink furnishing;

doctor roller for contacting with the peripheral surface of said metering roller at a position downstream of the contact position between said intermediate roller and said metering roller and upstream of the contact position between said metering roller and said form roller, said doctor roller including means for selectively switching the rotation of the doctor roller between a rotation for scraping off the ink from the peripheral surface of said metering roller and a rotation for not scraping off the ink;

an ink fountain opposing to the upper portion of said doctor roller and opened at the front side and the upper side, and constituted of booth side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain; and first gap adjusting means separately provided in said ink fountain for respective of divided zones defined along axial direction of said fountain roller for adjusting said first gap, an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

said apparatus being selectively operable in:

an entire surface ink furnishing mode, in which said first gap is held fully opened, said doctor roller being rotated to scrape off the ink of the peripheral surface of said metering roller, the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said intermediate roller and contact between the peripheral surfaces of said intermediate roller and said metering roller for supplying to the peripheral surface of said metering roller, the excess amount of ink on the peripheral surface of said metering roller is scraped off by said doctor roller and returned to said ink fountain for supplying a substantially uniform amount of ink at any axial position of said metering roller to a printing plate on a plate cylinder via the peripheral surface of said form roller, and a local ink furnishing mode, in which said first gap is adjusted to be narrower to the necessary size with respect to separated zones by the adjusting means, said doctor roller being rotated in the mode not scraping off the ink from the peripheral surface of said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said intermediate roller and through contact between the peripheral surfaces of said intermediate roller and said metering roller for supplying to the peripheral surface of said metering roller and further through contact between the peripheral surface of said metering roller and the peripheral surface of said doctor roller, thus supplying the ink supplied on said metering roller to a printing plate on a plate cylinder via the peripheral surface of said form roller.

18. An ink furnishing apparatus as set forth in claim 17, wherein said fine recesses of said metering roller are cavities regularly arranged on the peripheral surface.

19. An ink furnishing apparatus as set forth in claim 17, wherein said fine recesses of said metering roller are recesses opening the peripheral surface, in which hollow portions uniformly distributed an outer periphery are opened to the peripheral surface.

20. An ink furnishing apparatus as set forth in claim 17, wherein said doctor roller is made to rotate by rotation of said metering roller in contact between the peripheral surface of said metering roller and the peripheral surface of said doctor roller, and thus not scraping off the ink from the peripheral surface of said metering roller.

21. An ink furnishing apparatus as set forth in claim 17, wherein said doctor roller rotates in a direction for shifting the peripheral surface of said doctor roller in the same direction in a direction of the peripheral surface of said metering roller at the contact point and at a speed substantially equal to the peripheral speed of the metering roller, and thus not scraping off the ink from the peripheral surface of said metering roller.

22. An ink furnishing apparatus as set forth in claim 17, wherein said doctor roller rotates at lower peripheral speed than that of said metering roller, and thus scraping off the ink from the peripheral surface of said metering roller.

23. An ink furnishing apparatus as set forth in claim 17, wherein said doctor roller rotates at opposite direction to cause shifting of the peripheral surface in a direction opposite to the shifting direction of the peripheral surface of said metering roller, at the contact positions, and thus scraping off the ink from the peripheral surface of said metering roller.

24. An ink furnishing apparatus as set forth in claim 17, wherein the unevenness of said uneven surface roller comprises a plurality of projections regularly surrounded by the grooves in the circumference thereof.

25. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers;

whereby said ink furnishing apparatus being in operation such a manner that the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said first intermediate roller, through contact between said peripheral surfaces of both of said first and second intermediate cylinders and the peripheral surface of said ink cylinder, and through contact between the peripheral surfaces of said second intermediate roller and said metering roller for supplying to the peripheral surface of said metering roller, the excess amount of ink on the peripheral surface of said metering roller is scraped off by said doctor means and returned to said ink fountain for supplying substantially uniform amount of ink at any axial position of said metering roller to a printing plate on a plate cylinder via the peripheral surface of said form roller.

26. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers and reciprocating in an axial direction for a given stroke;

whereby said ink furnishing apparatus being in operation such a manner that the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said first intermediate roller, through contact between said peripheral surfaces of both of said first and second intermediate cylinders and the peripheral surface of said ink cylinder, extension in axial direction on the peripheral surface caused by rotation and reciprocal motion of said ink cylinder and through contact between the peripheral surfaces of said second intermediate roller and said metering roller for supplying to the peripheral surface of said metering roller, the excess amount of ink on the peripheral surface of said metering roller is scraped off by said doctor means and returned to said ink fountain for supplying substantially uniform amount of ink at any axial position of said metering roller to a printing plate on a plate cylinder via the peripheral surface of said form roller.

27. An ink furnishing apparatus as set forth in claim 25 or 26, wherein said fine recesses of said metering roller are cavities regularly arranged on the peripheral surface.

28. An ink furnishing apparatus as set forth in claim 25 or 26, wherein said fine recesses of said metering roller are recesses opening the peripheral surface, in which hollow portions uniformly distributed an outer periphery are opened to the peripheral surface.

29. An ink furnishing apparatus as set forth in claim 25 or 26, wherein said doctor means is a doctor blade.

30. An ink furnishing apparatus as set forth in claim 25 or 26, wherein said doctor means is a doctor bar.

31. An ink furnishing apparatus as set forth in claim 25 or 26, wherein said doctor means is a doctor roller rotating at lower peripheral speed than that of said metering roller.

32. An ink furnishing apparatus as set forth in claim 25 or 26, wherein said doctor means is a doctor roller rotating at opposite direction to cause shifting of the peripheral surface in a direction opposite to the shifting direction of the peripheral surface of said metering roller, at the contact positions.

33. An ink furnishing apparatus as set forth in claim 25 or 26, wherein the unevenness of said uneven surface roller comprises a plurality of projections regularly surrounded by the grooves in the circumference thereof.

34. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

first gap adjusting means separately provided in said ink fountain for respective of divided zones defined along an axial direction of said fountain roller for adjusting said first gap;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers;

said apparatus being selectively operable in:

an entire surface ink furnishing mode, in which said first gap is held fully opened, said doctor means is placed in contact with said metering roller, the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said first intermediate roller, contact between said peripheral surfaces of both said first and second intermediate cylinders and the peripheral surface of said ink cylinder, and contact between the peripheral surfaces of said second intermediate roller and said metering roller for supplying to the peripheral surface of said metering roller, the excess amount of ink on the peripheral surface of said metering roller is scraped off by said doctor means and returned to said ink fountain for supplying a substantially uniform amount of ink an any axial position of said metering roller to a printing plate on a plate cylinder via the peripheral surface of said form roller, and a local ink furnishing mode, in which said first gap is adjusted to be narrower to the necessary size with respect to separated zones by the adjusting means, said doctor means being released away from the peripheral surface of said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said intermediate roller, contact between the peripheral surfaces of both of said first and second intermediate cylinders and the peripheral surface of said ink cylinder, and contact between the peripheral surfaces of said second intermediate roller and said metering roller for supplying to the peripheral surfaces of said metering roller and thus supplying the ink supplied on said metering roller to a printing plate on a plate cylinder via the peripheral surface of said form roller.

35. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor means for contacting with the peripheral surface of said metering roller at a position downstream of the contact position between said intermediate roller and said metering roller and upstream of the contact position between said metering roller and said form roller;

an ink fountain opposing to the upper portion of said doctor means and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

first gap adjusting means separately provided in said ink fountain for respective of divided zones defined along an axial direction of said fountain roller for adjusting said first gap;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers and reciprocating in an axial direction for a given stroke;

said apparatus being selectively operable in:

an entire surface ink furnishing mode, in which said first gap is held fully opened, said doctor means is placed in contact with said metering roller, the ink drawn from said ink fountain by rotation of said fountain roller and having a thickness corresponding to said first gap is supplied to the peripheral surface with compression by passing through said second gap, is provided fluidity by compression and disrupter through contact between the peripheral surfaces of said uneven surface roller and said first intermediate roller, contact between the peripheral surfaces of both of said first and second intermediate cylinders and the peripheral surface of said ink cylinder, extension in axial direction on the peripheral surface caused by rotation and reciprocal motion of said ink cylinder and contact between peripheral surfaces of said second intermediate roller and said metering roller for supplying to the peripheral surface of said metering roller, the excess amount of ink on the peripheral surface of said metering roller is scraped off by said doctor means and returned to said ink fountain for supplying a substantially uniform amount of ink at any axial position of said metering roller to a printing plate on a plate cylinder via the peripheral surface of said form roller, and a local ink furnishing mode, in which said first gap is adjusted to be narrower to the necessary size with respect to separated zones by the adjusting means, said doctor means being released away from the peripheral surface of said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said first intermediate roller, contact between the peripheral surfaces of both of said first and second intermediate cylinders and the peripheral surface of said ink cylinder, extension in axial direction on the peripheral surface caused by rotation and reciprocal motion of said ink cylinder and contact between the peripheral surfaces of said second intermediate roller and said metering roller for supplying to the peripheral surfaces of said metering roller and thus supplying the ink supplied on said metering roller to a printing plate on a plate cylinder via the peripheral surface of said form roller.

36. An ink furnishing apparatus as set forth in claim 34 or 35, wherein said fine recesses of said metering roller are cavities regularly arranged on the peripheral surface.

37. An ink furnishing apparatus as set forth in claim 34 or 35, wherein said fine recesses of said metering roller are recesses opening the peripheral surface, in which hollow portions uniformly distributed an outer periphery are opened to the peripheral surface.

38. An ink furnishing apparatus as set forth in claim 34 or 35, wherein said doctor means is a doctor blade.

39. An ink furnishing apparatus as set forth in claim 34 or 35, wherein said doctor means is a doctor bar.

40. An ink furnishing apparatus as set forth in claim 34 or 35, wherein said doctor means is a doctor roller rotating at lower peripheral speed than that of said metering roller.

41. An ink furnishing apparatus as set forth in claim 34 or 35, wherein said doctor means is a doctor roller rotating at opposite direction to cause shifting of the peripheral surface in a direction opposite to the shifting direction of the peripheral surface of said metering roller, at the contact positions.

42. An ink furnishing apparatus as set forth in claim 34 or 35, wherein the unevenness of said uneven surface roller comprises a plurality of projections regularly surrounded by the grooves in the circumference thereof.

43. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor roller for contacting with the peripheral surface of said metering roller at a position downstream of the contact position between said intermediate roller and said metering roller and upstream of the contact position between said metering roller and said form roller, said doctor roller including means for selectively switching the rotation of the doctor roller between a rotation for scraping off the ink from the peripheral surface of said metering roller and a rotation for not scraping off the ink;

an ink fountain opposing to the upper portion of said doctor roller and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

first gap adjusting means separately provided in said ink fountain for respective of divided zones defined along an axial direction of said fountain roller for adjusting said first gap;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers;

said apparatus being selectively operable in:

an entire surface ink furnishing mode, in which said first gap is held fully opened, said doctor roller being rotated to scrape off the ink from the surface of said metering roller, the ink drawn from said ink fountain by rotation of said fountain roller and having a thickness corresponding to said first gap is supplied to the peripheral surface with compression by passing through said second gap, is provided fluidity by compression and disrupter through contact between said peripheral surfaces of said uneven surface roller and said first intermediate roller, contact between the peripheral surfaces of both said first and second intermediate cylinders and the peripheral surface of said ink cylinder, and contact between the peripheral surfaces of said second intermediate roller and said metering roller for supplying to the peripheral surface of said metering roller, the excess amount of ink on the peripheral surface of said metering roller is scraped off by said doctor roller and returned to said ink fountain for supplying a substantially uniform amount of ink at any axial position of said metering roller to a printing plate on a plate cylinder via the peripheral surface of said form roller, and a local ink furnishing mode, in which said first gap is adjusted to be narrower to the necessary size with respect to separated zones by the adjusting means, said doctor roller being rotated in the mode not scraping off the ink from the peripheral surface of the said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said intermediate roller, and through contact between said peripheral surfaces of both of said first and second intermediate cylinders and the peripheral surface of said ink cylinder, and contact between the peripheral surfaces of said second intermediate roller and said metering roller for supplying to the peripheral surface of said metering roller and further through contact between the peripheral surface of said metering roller and the peripheral surface of said doctor roller, thus supplying the ink supplied on said metering roller to a printing plate on a plate cylinder via the peripheral surface of said form roller.

44. An ink furnishing apparatus for a printing press for performing printing by furnishing an ink to a printing plate on a plate cylinder, comprising:

a form roller rotating in contact with a peripheral surface of the printing plate;

a metering roller rotating with contacting a peripheral surface thereof with the upstream side of the peripheral surface of said form roller in the direction of ink furnishing, and having a uniformly distributed large number of fine recesses on a peripheral surface thereof for receiving the ink;

a second intermediate roller rotating with contacting a peripheral surface thereof with the upstream side of the peripheral surface of said metering roller in the direction of ink furnishing;

doctor roller for contacting with the peripheral surface of said metering roller at a position downstream of the contact position between said intermediate roller and said metering roller and upstream of the contact position between said metering roller and said form roller, said doctor roller including means for selectively switching the rotation of the doctor roller between a rotation for scraping off the ink from the peripheral surface of said metering roller and a rotation for not scraping off the ink;

an ink fountain opposing to the upper portion of said doctor roller and opened at the front side and the upper side, and constituted of both side plates and tilted base;

a fountain roller having a peripheral surface located at a position for blocking the opened front side of said ink fountain, a position adjacent the front edge of said ink fountain via a first gap, and shifting downwardly at the position mating with said front side of said ink fountain;

first gap adjusting means separately provided in said ink fountain for respective of divided zones defined along an axial direction of said fountain roller for adjusting said first gap;

an uneven surface roller positioned adjacent the peripheral surface of said fountain roller at the downstream side position via a second gap narrower than said first gap, rotating with contacting with the peripheral surface of the intermediate roller at the upstream side position, and having a uniformly distributed unevenness;

a first intermediate roller rotating with contacting with the downstream side of the peripheral surface of said uneven surface roller; and an ink cylinder rotating with contacting with the peripheral surfaces of both of said first and second intermediate rollers and reciprocating in an axial direction for a given stroke;

said apparatus being selectively operable in:

an entire surface ink furnishing mode, in which said first gap is held fully opened, said doctor roller being rotated to scrape off the ink from the peripheral surface of said metering roller, the ink drawn from said ink fountain by rotation of said fountain roller and having a thickness corresponding to said first gap is supplied to the peripheral surface with compression by passing through said second gap, is provided fluidity by compression and disrupter through contact between said peripheral surfaces of said uneven surface roller and said first intermediate roller, contact between said peripheral surfaces of both of said first and second intermediate rollers and the peripheral surface of said ink cylinder, extension in axial direction on the peripheral surface caused by rotation and reciprocal motion of said ink cylinder and contact between the peripheral surfaces of said second intermediate roller and said metering roller for supplying to the peripheral surface of said metering roller, the excess amount of ink on the peripheral surface of said metering roller is scraped off by said doctor roller and returned to said ink fountain for supplying a substantially uniform amount of ink at any axial position of said metering roller to a printing plate on a plate cylinder via the peripheral surface of said form roller, and a local ink furnishing mode, in which said first gap is adjusted to be narrower to the necessary size with respect to separated zones by the adjusting means, said doctor roller being rotated in the mode not scraping off the ink from the peripheral surface of the said metering roller, the ink drawn from said ink fountain by rotation of said fountain roller per each separated zones in the desired thickness is supplied on the peripheral surface of said uneven surface roller at an amount corresponding to the thickness of the ink passed through said second gap per each separated zone, is provided fluidity by compression and disrupter through contact between the peripheral surfaces of said uneven surface roller and said first intermediate roller, through contact between said peripheral surfaces of both of said first and second intermediate rollers and the peripheral surface of said ink cylinder, extension in axial direction on the peripheral surface caused by the rotation and reciprocal motion of said ink cylinder and through contact between the peripheral surfaces of said second intermediate roller and said metering roller for supplying to the peripheral surface of said metering roller and further through contact between the peripheral surface of said metering roller and the peripheral surface of said doctor roller, thus supplying the ink supplied on said metering roller to a printing plate on a plate cylinder via the peripheral surface of said form roller.

45. An ink furnishing apparatus as set forth in claim 43 or 44, wherein said fine recesses of said metering roller are cavities regularly arranged on the peripheral surface.

46. An ink furnishing apparatus as set forth in claim 43 or 44, wherein said fine recesses of said metering roller are recesses opening the peripheral surface, in which hollow portions uniformly distributed an outer periphery are opened to the peripheral surface.

47. An ink furnishing apparatus as set forth in claim 43 or 44, wherein said doctor roller is made to rotate by rotation of said metering roller in contact between the peripheral surface of said metering roller and the peripheral surface of said doctor roller, and thus not scraping off the ink from the peripheral surface of said metering roller.

48. An ink furnishing apparatus as set forth in claim 43 or 44, wherein said doctor roller rotates in a direction for shifting the peripheral surface of said doctor roller in the same direction in a direction of the peripheral surface of said metering roller at the contact point and at a speed substantially equal to the peripheral speed of the metering roller, and thus not scraping off the ink from the peripheral surface of said metering roller.

49. An ink furnishing apparatus as set forth in claim 43 or 44, wherein said doctor roller rotates at lower peripheral speed than that of said metering roller, and thus scraping off the ink from the peripheral surface of said metering roller.

50. An ink furnishing apparatus as set forth in claim 43 or 44, wherein said doctor roller rotates at opposite direction to cause shifting of the peripheral surface in a direction opposite to the shifting direction of the peripheral surface of said metering roller, at the contact positions, and thus scraping off the ink from the peripheral surface of said metering roller.

51. An ink furnishing apparatus as set forth in claim 43 or 44, wherein the unevenness of said uneven surface roller comprises a plurality of projections regularly surrounded by the grooves in the circumference thereof.

* * * * *